US007937806B1

(12) United States Patent
Doyle

(10) Patent No.: US 7,937,806 B1
(45) Date of Patent: May 10, 2011

(54) DOOR SAFETY DEVICE

(76) Inventor: John J. Doyle, Riverview, FL (US)

( * ) Notice: Subject to any disclaimer, the term of this patent is extended or adjusted under 35 U.S.C. 154(b) by 462 days.

(21) Appl. No.: 11/973,117

(22) Filed: Oct. 5, 2007

Related U.S. Application Data

(60) Provisional application No. 60/850,005, filed on Oct. 6, 2006, provisional application No. 60/931,652, filed on May 24, 2007.

(51) Int. Cl.
*E05F 5/02* (2006.01)

(52) U.S. Cl. ..... 16/82; 16/83

(58) Field of Classification Search ..... 16/82, 83, 16/84, 85, 86 R, 86 A, 86 B, 86 C, 49; 109/63.5; 292/230, 231, 238, DIG. 15; 49/381, 383
See application file for complete search history.

(56) References Cited

U.S. PATENT DOCUMENTS

| | | | | |
|---|---|---|---|---|
| 1,354,079 | A | 9/1920 | McGarveu et al. | |
| 1,510,873 | A | 10/1924 | Tate | |
| 2,565,906 | A | 8/1951 | Berthene | |
| 3,137,025 | A | 6/1964 | Howard | |
| 4,261,140 | A | 4/1981 | McLean | |
| 4,368,555 | A | 1/1983 | Salerno | |
| 4,591,148 | A * | 5/1986 | Slater | 292/DIG. 15 |
| 4,653,140 | A * | 3/1987 | Hudec et al. | 16/82 |
| 4,982,474 | A | 1/1991 | Kjellstrom | |
| 5,123,685 | A | 6/1992 | Donovan | |
| 5,369,840 | A | 12/1994 | Salvador et al. | |
| 5,509,235 | A * | 4/1996 | Chander | 49/383 |
| 5,652,998 | A | 8/1997 | McKenzie | |
| 6,327,743 | B1 | 12/2001 | Rashid et al. | |
| 6,454,323 | B1 * | 9/2002 | Mills | 292/339 |
| 6,510,587 | B2 | 1/2003 | Urschel et al. | |
| 6,550,186 | B2 | 4/2003 | Haq | |
| 6,874,198 | B2 | 4/2005 | Renaud | |
| 7,065,830 | B2 * | 6/2006 | Bushey | 16/82 |
| 2001/0044985 | A1 | 11/2001 | Renaud | |
| 2003/0066163 | A1 * | 4/2003 | Hodson | 16/85 |
| 2004/0181902 | A1 * | 9/2004 | Pierce et al. | 16/49 |

* cited by examiner

*Primary Examiner* — Victor Batson
*Assistant Examiner* — Jeffrey O'Brien
(74) *Attorney, Agent, or Firm* — Frijouf, Rust & Pyle, P.A.

(57) ABSTRACT

An apparatus is disclosed for permitting or preventing a panel from closing an opening within a wall. A hinge secures the panel to the wall for pivoting the panel relative to the opening. The apparatus comprises an inverted generally u-shaped frame defining a slot for positioning to the panel. A bar member includes a first end and a second end. A fulcrum pivot is interposed between the first end and the second end for pivotably mounting the bar member to the inverted generally u-shaped frame. The fulcrum pivot pivots the bar member between a generally vertical position and a generally horizontal position. The bar member pivots to the generally vertical position for disengaging the second end from the wall for permitting the panel to close the opening of the wall. The bar member pivots into the generally horizontal position for engaging the stopper end with the wall for preventing the panel from closing the opening of the wall.

20 Claims, 14 Drawing Sheets

DOOR SAFETY DEVICE

CROSS-REFERENCE TO RELATED APPLICATIONS

This application claims benefit of U.S. Patent Provisional application Ser. No. 60/850,005 filed Oct. 6, 2006. All subject matter set forth in provisional application Ser. No. 60/850,005 is hereby incorporated by reference into the present application as if fully set forth herein.

This application claims benefit of U.S. Patent Provisional application Ser. No. 60/931,652 filed May 24, 2007. All subject matter set forth in provisional application Ser. No. 60/931,652 is hereby incorporated by reference into the present application as if fully set forth herein.

BACKGROUND OF THE INVENTION

1. Field of the Invention

This invention relates to a safety device and more particularly to the improved door safety device for preventing a door from closing an opening within a wall.

2. Background of the Invention

Various types of door safety devices have been proposed by the prior art for preventing a door from closing an opening within a wall. A door safety device may be beneficial by prohibiting an object and/or a limb of an individual from being compressed between the door and the opening within the wall upon closure of the door. Children are more susceptible to such injury since they are unaware of the danger and since their limbs are smaller in size. In addition, a door safety device may be beneficial by prohibiting an individual from being locked either outside or inside of a door way.

One particular type of door safety device includes a kickdown holder fastened to the lower edge of the door. The kickdown holder is pivoted from an ascending position to a descending position. The kickdown holder further includes a stopping surface for engaging the floor while in the descending position. With the kickdown holder engaging the floor, the door is prohibited from further movement in the direction of the closing within the wall. This particular door safety device can be easily disengaged by a child. In addition, an individual is required to bend down to the lower edge of the door in order to alter the position of the kickdown holder.

The following U.S. Patents are examples of attempt of the prior art to solve these problems.

U.S. Pat. No. 1,354,079 to McGarvey, et al. discloses a door check comprising a substantially vertical rod having a pivot between its ends. A bumper is carried at the lower end of the vertical rod. A means is apart from the bumper for engagement by the door whereby the bumper is at all times positively operated by the movement of the door into the path of the door as the latter is moved into a closed position.

U.S. Pat. No. 1,510,873 to Tate discloses a door check comprising a bracket attachable to a door jamb. A link is pivotally carried by the bracket for oscillation parallel to the plane of the front face of the door jamb and depending from the bracket, a bumper is carried by the link. A second link swingingly engages with the first named link and is oscillatable with the first named link or independently thereof in the same plane or in a plane at right angles to the first named link. A bumper is carried by the second named link and is disposed in the same vertical plane thereas but in advance of the plane of the second named bumper.

U.S. Pat. No. 2,565,906 to Berthene discloses a device for retaining a door ajar having the combination of a yoked portion adapted to skip over and embrace the top part of the door. A member projects from the yoked portion upwardly and away therefrom toward the top sill of the door, whereby the terminal of the member will abut against the sill for retaining the door ajar. A handle projects downwardly form the yoked portion for mounting and demounting the device from the door.

U.S. Pat. No. 3,137,025 to Howard discloses a door stop apparatus for attachment relative to a door frame and to a door hinged at one edge thereof to the frame. The door stop comprising obstruction means having a normal position between the door edge and the door frame for preventing complete closure of the door. Support means are connected to the obstruction means for supporting the obstruction means in the region of the door edge and the door frame. The obstruction means are manually movable to a position differing from the normal position whereby the door may be completely closed with respect to the door frame. The obstruction means are responsive to the force of gravity for causing the obstruction means to automatically return to its normal position upon the opening of the door. Retainer means are secured to the door frame in the region whereby the obstruction means may be manually moved into a position of engagement with the retainer means for preventing the obstruction means from attaining its normal position during movement of such door.

U.S. Pat. No. 4,261,140 to McLean discloses a protective device which is attached to a door and the surrounding casing for the purpose of providing maximum protection for the fingers of small children. The protective device includes a door stop device pivotally mounted on the front surface of the door, adjacent the free or unhinged edge, such that the stop automatically pivots downwardly and outwardly when the door opens to a position between the door and adjacent casing to prevent complete closure of the door until the stop device is reset. A flexible, retractible shield overlies the forward gap between the front edge of the hinged side of the door and adjacent casing sidewall. A flexible shield overlies the rear gap between the rear edge of the hinged side of the door and the casing. A yieldable, soft member forms a substantial portion of the vertical free edge of the door.

U.S. Pat. No. 4,368,555 to Salerno discloses a support device pivotally supporting a resilient body on the leading surface of either a door or a sliding door frame in a manner whereby the gravitational force on the body moves the body between a sliding door and the frame. The body is mounted on a rod which is accommodated in a mounting housing. The body is manually movable away from the door and the frame, so that the body is positioned by gravitational force in abutment with the leading surface of the door when the door is closed. This permits the door to be securely closed with its leading edge in abutment with the frame. The body is interposed by gravitational force between the leading edge of the door and the frame when the door is open thereby preventing the door from closing fully by preventing the leading edge of the door from abutting the frame and thus protecting hands from being crushed between the door and the frame. A deactivation preventing device in the housing limits the extent of manual movement of the ball away from the leading edges of the door and the frame to prevent positioning of the ball at a point from which the gravitational force on the ball moves the ball toward the leading surface of the door or the frame rather than between the door and the frame.

U.S. Pat. No. 4,982,474 to Kjellstrom discloses an arrangement for a door intended, in conjunction with the closing of same, to prevent injury by crushing between the door leaf and the case. The arrangement comprises a body component with a plane surface intended to be mounted against the door leaf. A longitudinal locking component is pivotally mounted in the body component. A spring acts between the aforementioned body and locking components, which have devices which define a relative angular position. This means essentially that the direction of longitudinal extension of the locking component forms a normal to the plane surface of the body component. The spring forces the components to adopt the aforementioned angular position. The body component with the locking component mounted in it is intended to be mounted on the inside of the door leaf in a position such that, as the door is opened from a closed position, the locking component, sliding against the door case along its length, finally leaves the case and freely adopts the aforementioned relative angular position. When the door is closed again, the free end of the locking component will come up against the case, thus preventing the door from being fully closed.

U.S. Pat. No. 5,123,685 to Donovan discloses a door stop apparatus arranged for securement to a door for cooperation with a door jamb, wherein a bracket mounting the slide portion of the organization includes an abutment leg orthogonally mounted to a slide bar. The slide bar further includes an abutment flange limiting projection of the abutment leg beyond the associated door relative to the support bracket. A modification of the invention includes a crossed tubular bracket structure utilizing a severed abutment leg within each tube section, and each abutment leg relative to an associated slide member is of a varying length to provide for adjustment of gap of an associated door relative to an associated door frame.

U.S. Pat. No. 5,369,840 to Salvador, et al. discloses a stop mechanism for a door associated with a jamb utilizing an arresting element. The arresting element is capable of withstanding force asserted on an object normally positioned between the door and the jamb. In addition, the arresting element is sized to provide a gap between the door and the jamb when the door is swung toward a closed position. A tether is also employed in the present invention which is connected to the arresting element, and permits the arresting element to lie in a first position in the vicinity of the closed door and associated jamb and in a second position between the door and the jamb when the door is again motivated toward closing. The tether is supported to the vicinity of the door jamb at a selected level above the ground surface.

U.S. Pat. No. 5,652,998 to McKenzie discloses a door stop mechanism to be used as a child safety device. The door stop mechanism of the invention is for a door with a rotating door opening mechanism and a door jamb. The invention includes a blocking element, a flexible positioning member and an attachment hook member integrally joined to form a single molded structure. The door stop mechanism of the invention is attached to the rotating shaft of a door opening mechanism, such that the door stop mechanism will rotate in direct relation to the rotation of the door opening mechanism. In its closed position, the door stop mechanism rests across the edge of the door to prevent the door from completely closing. To close the door, the door opening mechanism must be rotated and held in this rotated position while closing the door. When the door opening mechanism is rotated, the blocking element of the present invention is moved away from the door edge which allows the door to be closed. Since the door opening mechanism must be held in a rotated position, the door stop mechanism of the invention prevents the door from being unintentionally shut by a small child, or other person.

U.S. Pat. No. 6,327,743 to Rashid, et al. discloses a door safety device for use in conjunction with a door that is pivotably mounted to a wall. The safety device comprises a base member that mounts to either the door or the wall, and an engaging member that movably mounts to the engaging member for movement between operative and inoperative positions. In the operative position, the engaging member prevents the door from being moved into the closed position thereof. In the inoperative position, the engaging member is positioned such that the door can be moved to the closed position thereof.

U.S. Pat. No. 6,510,587 to Urschel, et al. discloses a door closure preventing device mounted on the inside surface of a door and having a pivotal stop moveable between a deactivated position within the periphery of the door and the extended position extending beyond the periphery of the door to prevent closure of the door. The pivotal stop is moved to its extended position following opening of the door by a user and is then released to move by a spring to an intermediate position projecting beyond the door periphery following which closure of the door results in engagement of the door jamb by the stop to prevent complete closure. Engagement of the stop with the door jamb also returns the stop to is fully extended position and actuates a rotary latch so that upon subsequent opening movement of the door by the user the stop is automatically returned to its fully retracted position to permit a conventional door closure apparatus to fully close the door.

U.S. Pat. No. 6,550,186 to Haq discloses a mechanism for preventing injury to a person's (especially a child's) hand when a fast-closing door slams against a door frame or jamb. The mechanism comprises a casing which is positioned within a hollowed out portion of the door. The casing is constructed with an opening disposed along the edge of the door. A metallic pendulum is housed and suspended within the casing such that the action of centrifugal force imparted by the fast-closing door will cause the pendulum to swing outwardly through the opening. A raised metal body is attached to the side molding of the door jamb and functions to engage the outwardly swung pendulum to prevent the door from completely closing.

U.S. Pat. No. 6,874,198 to Renaud discloses a gravity actuated door safety device, which prevent injury to fingers and pet's tails. A swinging door safety device comprises a pair of spaced parallel bars connected to one another at one end by a crossbar. At the opposite end of each bar, a counterweight is provided. Each bar has a ring attached at a point between the first and second ends. With the rings mounted to oppositely facing door knobs such that the crossbar spans the leading edge of the door, gravity acting on the counterweight biases the device to rotate such that the bars extend outward from the leading edge and prevent closure of the door by contacting the door jamb. The device is manually rotatable to a position wherein the bars do not extend forward of the door leading edge in order to fully close the door. A sliding door safety device comprises a mounting bracket secured near the leading edge of the sliding door. A lever is pivotally mounted to the bracket and rotatable between a stop position and a retracted position. Gravity acting on the lever automatically deploys the lever to the stop position when the door is opened due to the lever geometry.

U.S. Patent Application 20010044985 to Regis discloses a gravity actuated door safety device which prevents injury to fingers and pet's tails. A swinging door safety device comprises a pair of spaced parallel bars connected to one another at one end by a crossbar. At the opposite end of each bar, a counterweight is provided. Each bar has a ring attached at a point between the first and second ends. With the rings mounted to oppositely facing door knobs such that the crossbar spans the leading edge of the door, gravity acting on the counterweight biases the device to rotate such that the bars extend outward from the leading edge and prevent closure of the door by contacting the door jamb. The device is manually rotatable to a position wherein the bars do not extend forward of the door leading edge in order to fully close the door. A sliding door safety device comprises a mounting bracket secured near the leading edge of the sliding door. A lever is pivotally mounted to the bracket and rotatable between a stop position and a retracted position. Gravity acting on the lever automatically deploys the lever to the stop position when the door is opened due to the lever geometry.

Although the aforementioned prior art have contributed to the development of the art of door safety device, none of these prior art patents have solved the needs of this art.

Therefore, it is an object of the present invention to provide an improved door safety device for preventing a door from closing an opening within a wall.

Another object of this invention is to provide an improved door safety device for prohibiting an object and/or a limb of an individual from being compressed between the door and the opening within the wall upon closure of the door.

Another object of this invention is to provide an improved door safety device is easily installed to an existing door.

Another object of this invention is to provide an improved door safety device is that easily operated by an adult and cannot be operated by a small child.

Another object of this invention is to provide an improved door safety device wherein an adult may disengage the door safety device to permit the door to close the opening within the wall.

Another object of this invention is to provide an improved door safety device wherein upon removing the door from the opening the door safety device engages to prevent subsequent closing of the door within the opening of the wall.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved apparatus for permitting or preventing a panel from closing an opening within a wall. A hinge secures the panel to the wall for pivoting the panel relative to the opening. The apparatus comprises an inverted generally u-shaped frame defining a slot for positioning to the panel. A bar member includes a first end and a second end. A fulcrum pivot is interposed between the first end and the second end for pivotably mounting the bar member to the inverted generally u-shaped frame. The fulcrum pivot pivots the bar member between a generally vertical position and a generally horizontal position. The bar member pivots to the generally vertical position for disengaging the second end from the wall for permitting the panel to close the opening of the wall. The bar member pivots into the generally horizontal position for engaging the stopper end with the wall for preventing the panel from closing the opening of the wall.

In another embodiment of the invention, the invention relates to an improved child protective device engaged by an adult for preventing a child from closing an opening with a door. The child protective device including a L-shaped frame defining a first leg and a second leg. The second leg has a leg support surface and a leg engaging surface. A base has a surface defining a third leg extending generally perpendicular to the second leg. A slot is defined by the first leg, the second leg and the third leg for positioning adjacent to the door. A bar member has a first end and a second end. A fulcrum pivot is interposed between the first end and the second end for pivotably mounting the bar member to the base. The fulcrum pivot pivots the bar member between a generally vertical position and a generally horizontal position. The fulcrum pivot is positioned adjacent to the first end for normally pivoting the bar member into the generally horizontal position. A flexible cable is secured to the first end for conveying a descending vertical force from the flexible cable to the first end for pivoting the arm member from the generally horizontal position to the generally vertical position. The bar member pivoted from the generally horizontal position to the generally vertical position by the adult applying a downward vertical force on the flexible cable for disengaging the second end from the wall for permitting the door to close the opening of the wall. The bar member normally pivoting from the generally vertical position to the generally horizontal position upon the child displacing the door from the opening for engaging the second end with the wall for preventing the child from closing the opening with the door.

In a more specific embodiment of the invention, the base includes a channel for slidably engaging the leg support surface of the second leg for altering the distance between the first leg and the third leg. A clamp locks the base relative to the second leg. A groove is within the second leg for aligning the second leg relative to the clamp. The clamp includes a clamp block positioned adjacent to the leg engaging surface. A fastener extends from the base, through the groove and to the clamp block for applying a compressive force between the base and the clamp block.

In another example of the invention, the base includes a first shoulder and a second shoulder extending substantially perpendicular to the second leg. The first shoulder has a first pivot receiver having an elevation greater than an elevation of the second leg. The second shoulder has a second pivot receiver having an elevation greater than an elevation of the second leg. A passage is defined between the first shoulder and the second shoulder for positioning the bar member therebetween. The first pivot receiver of the first shoulder pivotably secures the fulcrum pivot to the first shoulder. The second pivot receiver of the second shoulder pivotably secures the fulcrum pivot to the second shoulder. The first and second pivot receiver has an elevation greater than an elevation of the second clamp block for positioning the bar member parallel to the second leg in the generally horizontal position.

In another embodiment of the invention, the invention includes a first flexible cable is secured to the first end of the bar member and is positioned on the interior side of the panel. The first flexible cable applies a generally descending vertical force to the first end of the bar member for pivoting the bar member from the generally horizontal position to the generally vertical position. A second flexible cable is secured to the first end of the bar member and is positioned on the exterior side of the panel. The second flexible cable applies a generally descending vertical and horizontal force to the first end of the bar member for pivoting the bar member from the generally horizontal position to the generally vertical position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
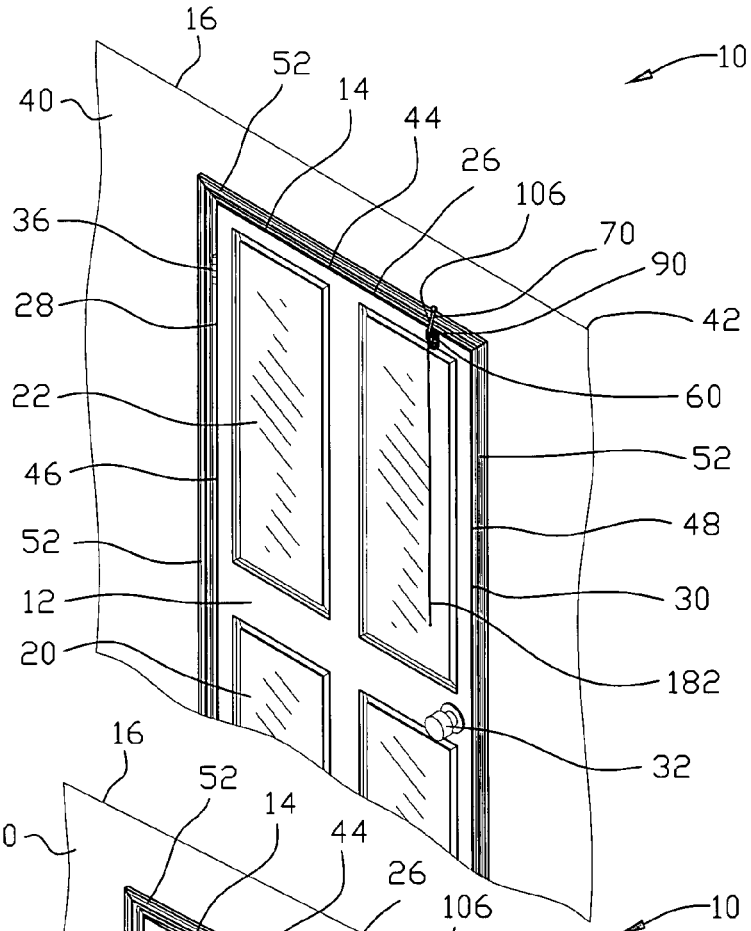
FIG. 1 is a front isometric view of a door safety device permitting a door to close an opening within a wall incorporating the present invention.
Figure 2:
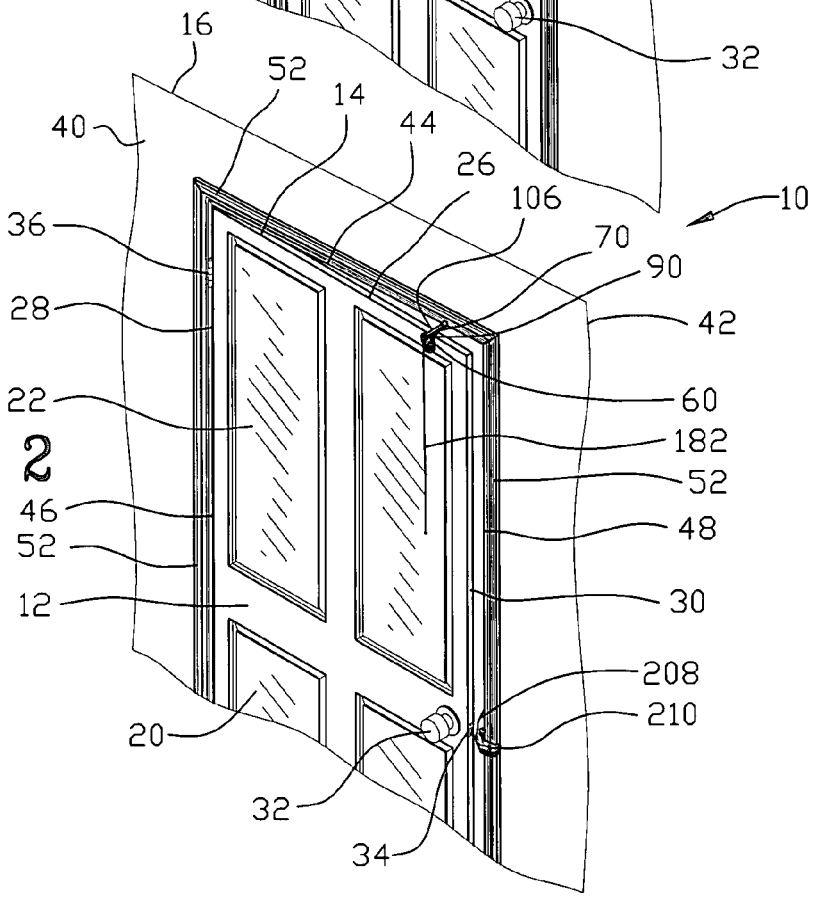
FIG. 2 is a view similar to FIG. 1 illustrating the door safety device preventing the door from closing the opening within the wall.

FIGS. 1 and 2 are front isometric views of an apparatus 10 for permitting or preventing a panel 12 from closing an opening 14 within a wall 16. In FIG. 1 the apparatus 10 permits a panel 12 to close the opening 14 within the wall 16. In FIG. 2 the apparatus 10 prevents the panel 12 from closing the opening 14 within the wall 16. The panel 12 is illustrated as a door 20 but it should be understood the panel 12 may include a boarder, fence, door or other closure.

The door 20 includes an interior side 22, an exterior side 24, a top edge 26, a hinge edge 28 and a handle edge 30. The door 20 may include a door knob 32 operating a latching mechanism 34 for locking the door within the opening 14.

The wall 16 has an interior side 40 and an exterior side 42. The opening 14 is defined by a top jamb 44, a hinge jamb 46 and a handle jamb 48 within the wall 16. The handle jamb 48 may include a latching receiver 50 for engaging the latching mechanism 34 upon the door 20 closing the opening 14. The interior side 40 may include a molding boarder 52 secured to the wall 16 and adjacent to the top jamb 44, hinge jamb 46 and handle jamb 48. A hinge 36 pivotably secures the hinge edge 28 of the door 20 to the hinge jamb 46 of the wall 16 for pivoting the door 20 relative to the opening 14.

FIGS. 1-14 are various view of a first embodiment of the apparatus 10. The apparatus 10 comprises an inverted generally u-shaped frame 60 defining a slot 62 for positioning adjacent to the top edge 26, the interior side 22 and the exterior side 24 of the door 20. The inverted generally u-shaped frame 60 includes a first leg 64, a second leg 66 and a base 68.

A bar member 70 has a first end 72 and a second end 74. A fulcrum pivot 80 is interposed between the first end 72 and the second end 74. The fulcrum pivot 80 pivotably mounts the bar member 70 to the inverted generally u-shaped frame 60. The fulcrum pivot 80 pivots the bar member 70 between a generally vertical position 82 and a generally horizontal position 84.

Figure 3:
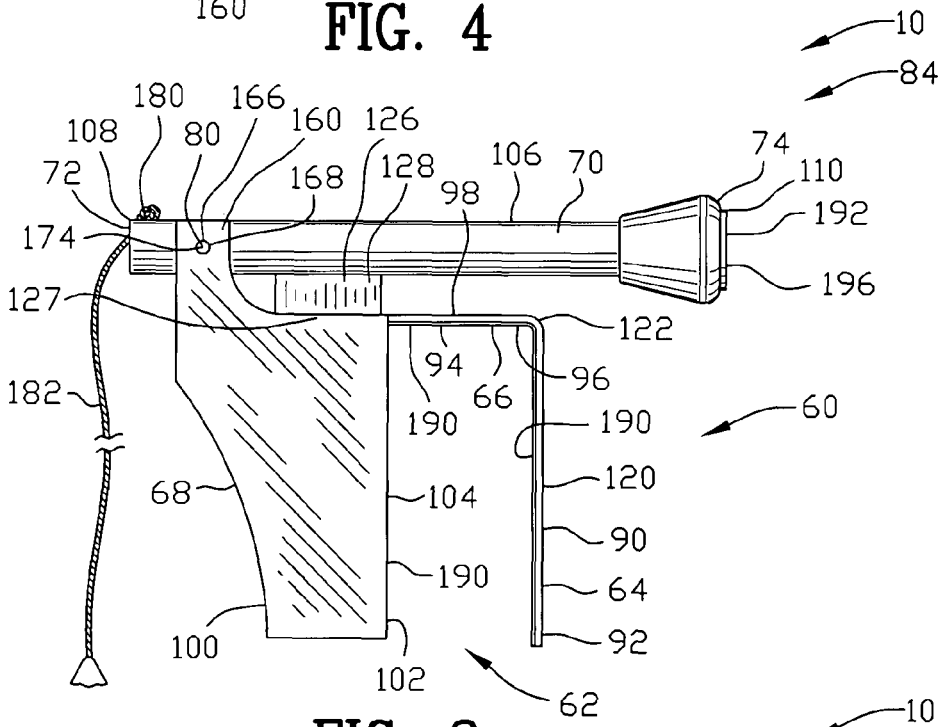
FIG. 3 is a side view of the door safety device as shown in FIG. 1.
Figure 5:
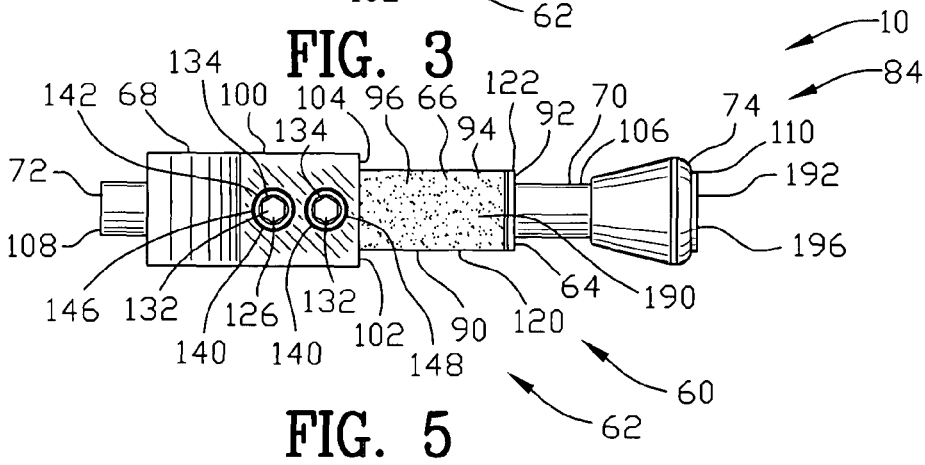
FIG. 5 is a bottom of view of FIG. 3.
Figure 6:
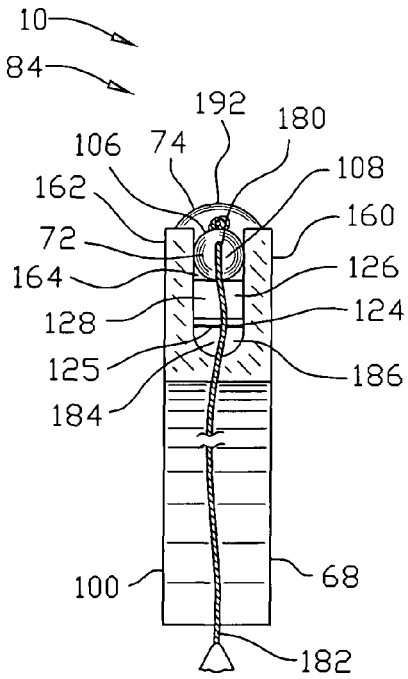
FIG. 6 is a rear view of FIG. 3.
Figure 7:
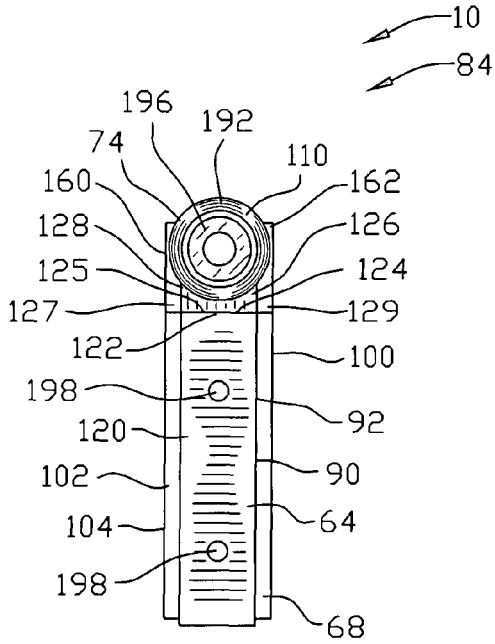
FIG. 7 is a front view of FIG. 3.
Figure 9:
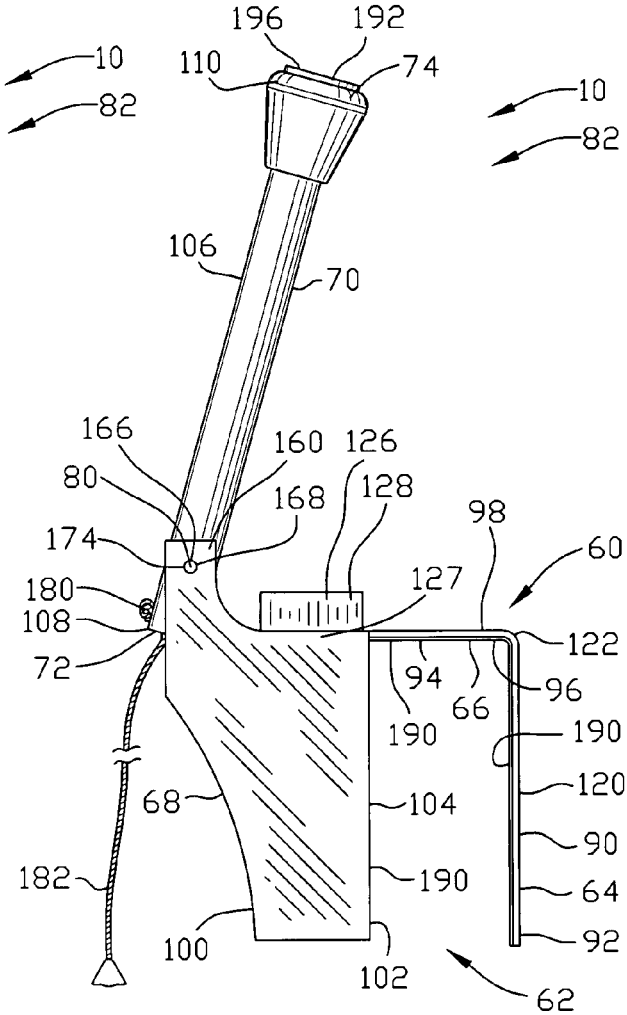
FIG. 9 is a view similar to FIG. 3 illustrating a bar member in a generally vertical position.

As best seen in FIGS. 1 and 9, the bar member 70 pivots to the generally vertical position 82 for disengaging the second end 74 from the wall 16 for permitting the door 20 to close the opening 14 of the wall 16. As best seen in FIGS. 2 and 3, the bar member 70 pivots into the generally horizontal position 84 for engaging the second end 74 with the wall 16 for preventing the door 20 from closing the opening 14 of the wall 16.

The apparatus 10 may alternatively comprise a L-shaped frame 90 defining a first leg 92 and a second leg 94. The second leg 94 has a leg support surface 96 and a leg engaging surface 98. A base 100 includes a surface 102 for defining a third leg 104 extending generally perpendicular to the second leg 94. A slot 62 is defined by the first leg 92, the second leg 94 and the third leg 104 for positioning adjacent the exterior side 24, the top edge 26 and the interior side 22 of the door 20 respectively. A bar member 106 has a first end 108 and a second end 110. A fulcrum pivot 80 is interposed between the first end 108 and the second end 110 for pivotably mounting the bar member 106 to the base 100. The fulcrum pivot 80 pivots the bar member between a generally vertical position 82 and a generally horizontal position 84. The fulcrum pivot 80 is positioned adjacent to the first end 108 for normally pivoting the bar member 106 into the generally horizontal position 84.

As best seen in FIGS. 1 and 9, the bar member 106 pivots to the generally vertical position 82 for disengaging the second end 110 from the wall 16 for permitting the door 20 to close the opening 14 of the wall 16. As best seen in FIGS. 2 and 3, the bar member 106 pivots to the generally horizontal position 84 during the door 20 exiting the opening 14 for engaging the second end 110 with the wall 16 for preventing the door 20 from closing within the opening 14 of the wall 16.

Preferably, the first leg 92 and the second leg 94 of the L-shaped frame 90 is an integral one piece unit 120 including a ninety degree bend 122. The integral one piece unit 120 may be constructed from a metallic, polymeric or other rigid material.

Figure 4:
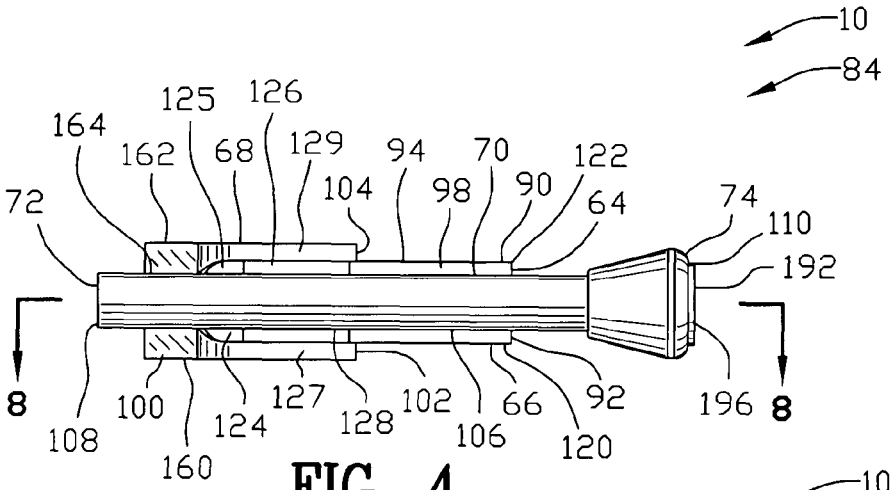
FIG. 4 is a top view of FIG. 3.
Figure 8:
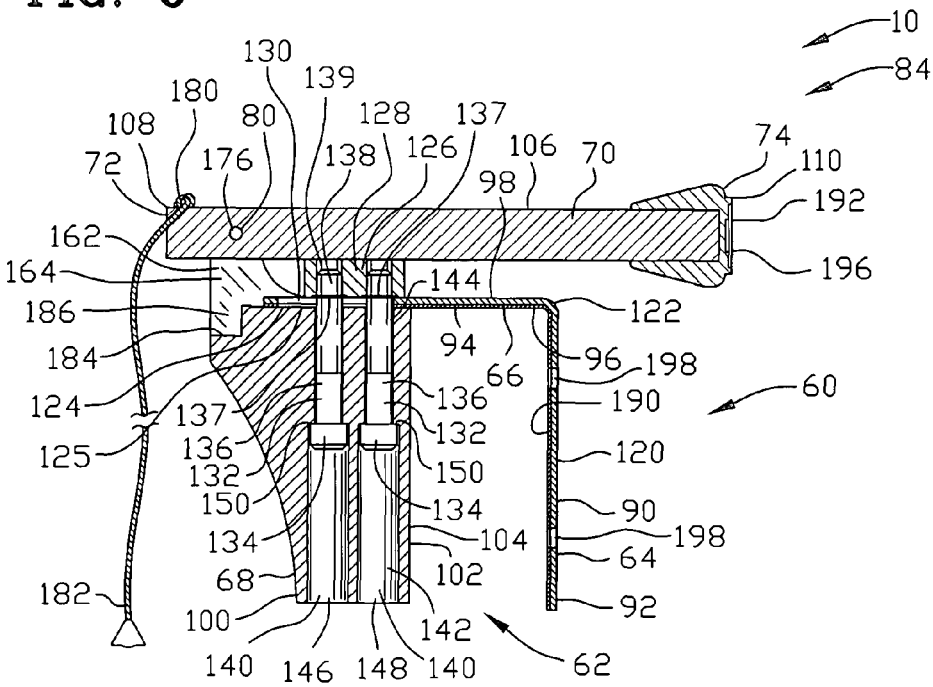
FIG. 8 is a sectional view along line 8-8 in FIG. 4.
Figure 10:
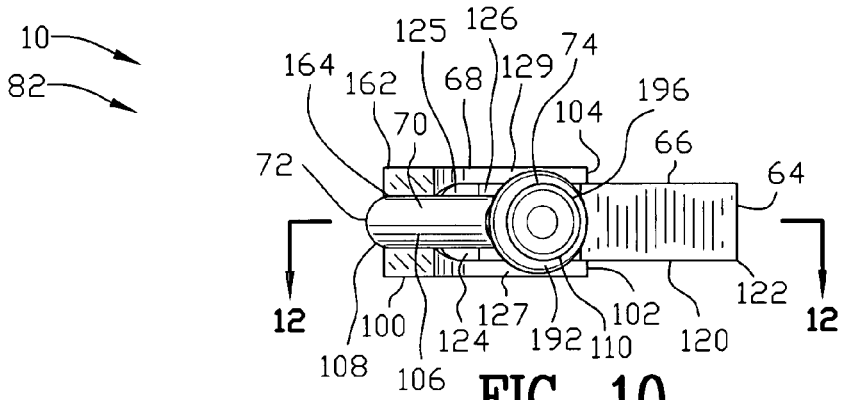
FIG. 10 is top view of FIG. 9.
Figure 11:
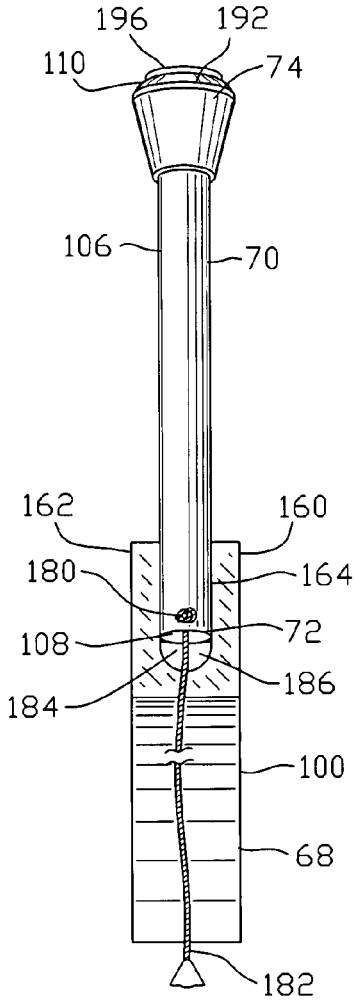
FIG. 11 is a rear view of FIG. 9.
Figure 12:
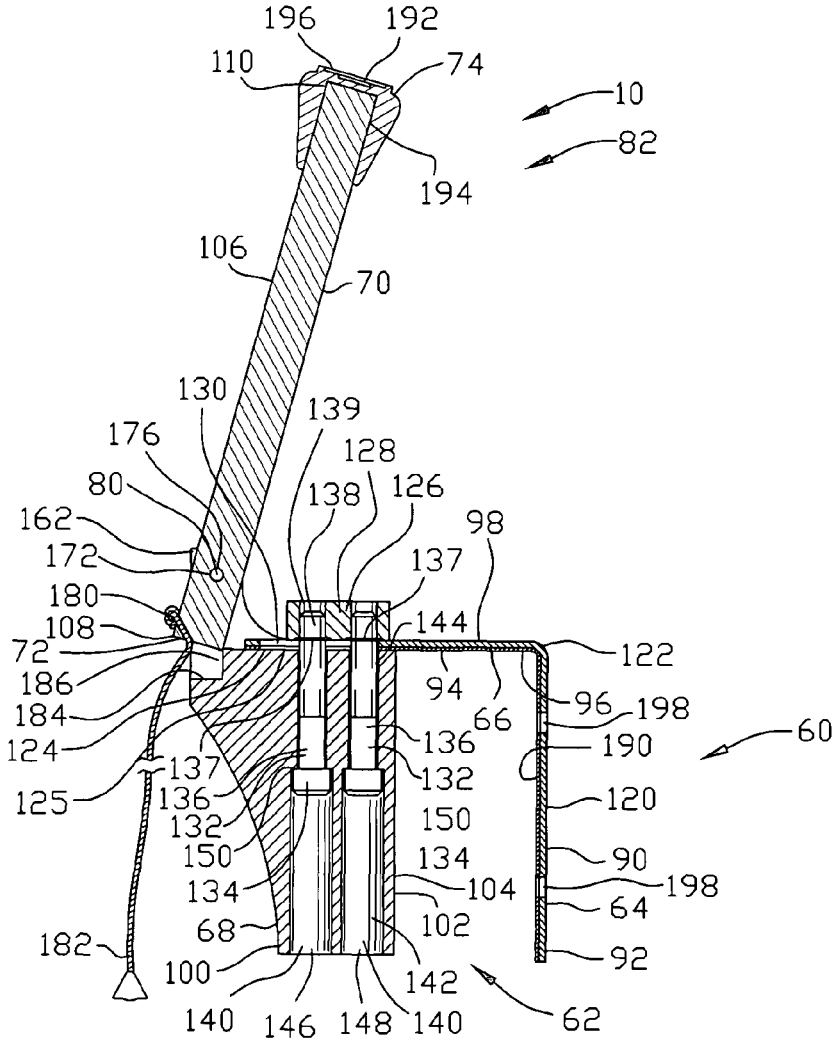
FIG. 12 is a sectional view along line 12-12 in FIG. 10.

As best seen in FIGS. 4, 8 and 12, the base 100 includes a channel 124 for slidably engaging the leg support surface 96 of the second leg 94 for altering the distance between the first leg 92 and the third leg 104. The channel 124 includes a channel surface 125, first channel wall 127 and a second channel wall 129. Preferably, the first and second side walls 125 and 127 extend perpendicular to the channel surface 125 and have an elevation greater than an elevation of the second leg 94.

A clamp 126 locks the base 100 relative to the second leg 94 for terminating further sliding of the L-shaped frame 90 relative to the base 100. The clamp 126 includes the base 100 and a clamp block 128 positioning adjacent to said leg engaging surface. A groove 130 is located within the second leg 94 for permitting a clamp fastener 132 to transverse through the second leg 94. The groove 130 also serves to align the second leg 94 relative the base 100 and clamp 126. The clamp fastener 132 includes a fastener head 134, a fastener shaft 136 and a male threading 138.

The base 100 may include one or more passages 140 having a first bore diameter 142 and a second bore diameter 144. In the first embodiment of the invention, a first passage 146 and a second passage 148 are positioned parallel relative to the bar member 70. Since the first and second passages 146 and 148 are parallel to the bar member 70, only a single groove 130 is required to permit the L-shaped frame 90 to slide relative to the base 100. The first bore diameter 142 is commensurate with the diameter of the fastener head 134. The second bore diameter 144 is commensurate with the diameter of the fastener shaft 136 and the male threading 138. Since first bore diameter 142 is larger than the second bore diameter a fastener ridge surface 150 is created between the first bore diameter 142 and the second bore diameter 144. The clamp fastener 132 will slidably engage the first and second passages 146 and 148 until the fastener head 134 makes contact with the ridge surface 150. The fastener shaft 136 positions the male threading 138 through the groove 130 of the second leg 94 for engaging the clamp block 128. The clamp block 128 may include a female threading 139 for threadably engaging the male threading 138. Upon rotation of the clamp fastener 132, the male threading 138 threadably engages the female threading 139 to shorten the distance between the fastener head 134 and the clamp block 128 to produce a compressive force between the base 100 and the clamp block 128. The compressive force secures the second leg 94 against the channel surface 125 of the base 100 to fix the distance the first leg 92 and the third leg 104.

Preferably, the base 100 and the first and second channel walls 127 and 129 are an integral one piece unit. The integral one piece unit may be constructed from a metallic, polymeric or other rigid material. The one or more passages 140 including the first bore diameter 142 and the second bore diameter 144 may be constructed from drilling, punching or other methods. The clamp block 128 may also be constructed from a metallic, polymeric or other rigid material. The female threading 139 may be positioned within the clamp block 128 by drilling and tapping. Alternatively, the female threading 139 may be positioned by embedding a threaded nut or threaded cylinder within the clamp block 128.

As been seen in FIGS. 4 thru 14, the base 100 may further include a first shoulder 160 and a second shoulder 162 extending generally perpendicular to the second leg 94. A passage 164 is defined between the first and second shoulder 160 and 162. The bar member 106 is placed within the passage 164 for positioning the bar member 106 between the first and second shoulder 160 and 162. The first shoulder 160 has a first pivot receiver 166 for pivotably mounting the fulcrum pivot 80 to the base 100. The first pivot receiver 166 may include a first aperture 168 that traverses through the first shoulder 160. The second shoulder 162 has a second pivot receiver 170 for pivotably mounting the fulcrum pivot 80 to the base 100. The second pivot receiver 170 may include a second aperture 172 that traverses through the second shoulder 162. The first and second apertures 168 and 172 are aligned such that a pivot rod 174 may traverse from the first apertures 168 to the second aperture 172 wherein the pivot rod 174 is parallel to the channel surface 125 of the base 100. The elevation of both the first and second pivot receivers 166 and 170 are greater than the elevation of the second leg 94. In addition, the elevation of both the first and second pivot receivers 166 and 170 may be such that the bar member 106 is supported by the clamp block 128 when the bar member 106 is positioned in the generally horizontal position 84.

The bar member 106 may include a bar aperture 176 that traverses through the center of the cross section of the bar member 106 and parallel that the channel surface 125. To secure the bar member 106 to the base 100, the bar member 106 is positioned between the first and second shoulder 160 and 162 such that the first and second apertures 168 and 172 are aligned to the bar aperture 176. The pivot rod 174 is inserted from the first aperture 168, through the bar member 106 and into the second aperture 172. The bar member 106 is able to pivot about the pivot rod 174 between the generally vertical position 82 and the generally horizontal position 84.

Preferably, the base 100 and the first and second shoulders 160 and 162 are an integral one piece unit. The integral one piece unit may be constructed from a metallic, polymeric or other rigid material. The first and second apertures 168 and 172 may be constructed from drilling, punching or other methods. The bar member 106 may also be constructed from a metallic, polymeric or other rigid material. The bar aperture 176 may be positioned within the bar member 106 by drilling and tapping. The pivot rod 174 may also be constructed from a metallic, polymeric or other rigid material.

The bar member 70 is position from the generally horizontal position 84 to the generally vertical position 82 by a descending vertical force applied to the first end 72 of the bar member 70. The descending vertical force causes the bar member 70 to pivot about the fulcrum pivot 80. A cable aperture 180 may be located on the first end 72 of the bar member 70. A flexible cable 182 is secured to the cable aperture 180 and hangs vertically from the apparatus 10. Upon an adult applying a downward vertical force on the flexible cable 182, the force is transferred to the first end 72 of the bar member 70 to pivot the bar member 70 about the fulcrum pivot 80. The flexible cable 182 may be constructed from nylon, steel or other flexible line.

The base 100 may include a stop surface 184 for striking the first end 72 of the bar member 70 upon the bar member 70 positioned in the generally vertical position 82. The stop surface 184 terminates further pivoting of the bar member 70. The stop surface 184 permits the first end 72 to have an elevation less than an elevation of the second leg 94 in the generally vertical position 82.

The first leg 92, the leg support surface 96 of the second leg 94 and the third leg 104 of the base 100 may include a shielding layer 190 for avoiding direct contact between the first, second and third legs 92, 96 and 104 from the door. By avoiding direct contact between the first, second and third legs 92, 96 and 104 from the door any scratching that the legs 92, 96 and 104 may cause to the door may be eliminated. The shielding layer 190 may be constructed cotton, dense foam or other soft sheet material.

The second end 110 of the bar member 106 may have a stopper pad 192 for distributing an impact force between the second end 110 and the wall 16. The stopper pad 192 includes a chamber 194 for slidably engaging the second end 110 of the bar member 106. The stopper pad 192 further includes an impact surface 196 which has a larger area than the cross sectional area of the bar member 106. The impact surface 196 distributes the force over a larger area of the wall 16 than if the second end 110 of the bar member 106 alone made contact with the wall 16. Thus any damage by punching and/or scratching to the wall 16 by the bar member 106 upon impact will be avoided. The stopper pad 192 may be constructive from an elastic hydrocarbon polymer, a polymeric material or other semi-rigid material.

The first leg 92 includes a bore 198 for permitting a bore fastener 200 to transverse through the first leg 92 and anchor into the door 20. The bore fastener 200 applies a compressive force between the first leg 92 and the exterior side 24 of the door for locking the base 100, the first leg 92, and the second leg 94 relative to the door. The bore fastener 200 may include screws, bolts, rivets or other fasteners. As best seen in FIGS. 8, 12, 20 and 21 a locking washer 137 may be positioned between second leg 66 and clamp block 128 to prevent the clamp fastener 132 from loosing. The locking washes may include star locking washers.

FIGS. 16 thru 22 include a second embodiment of the invention, wherein the first passage 146 and a second passage 148 are positioned perpendicular relative to the bar member 70. Since the first and second passages 146 and 148 are perpendicular to the bar member 70, a first groove 130 and a second groove 131 are required to permit the L-shaped frame 90 to slide relative to the base 100. The body 100, channel 124, first and second channel wall 127 and 129, passages 140 and first and second shoulders 160 and 162 are an integral one piece unit. The integral one piece unit may be constructed from a polymeric material by injection molding.

Figure 21:
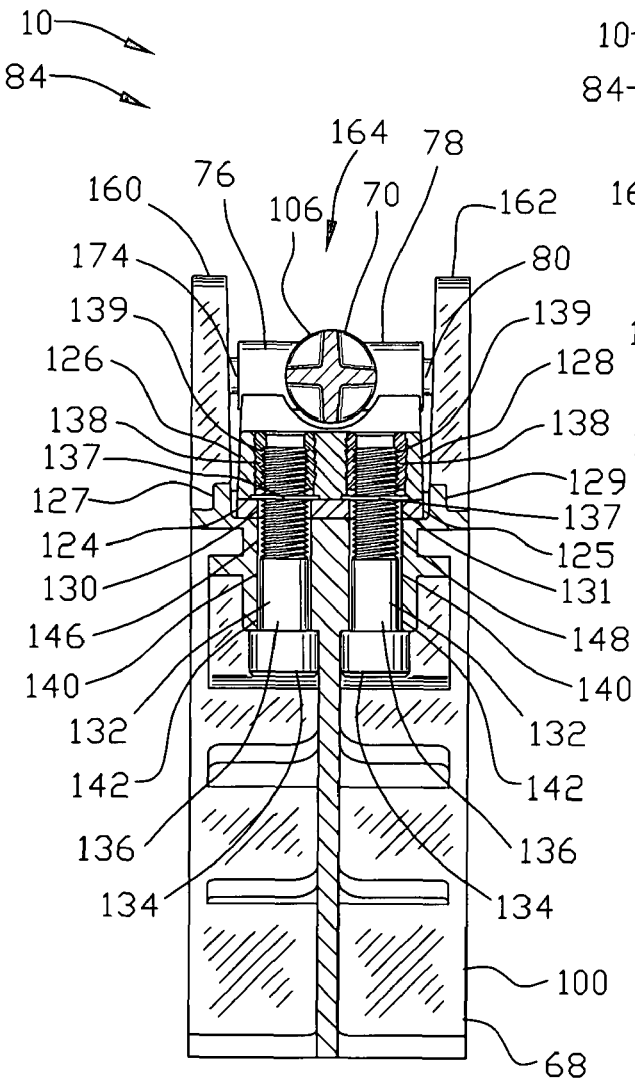
FIG. 21 is a sectional view along line 21-21 in FIG. 16.
Figure 22:
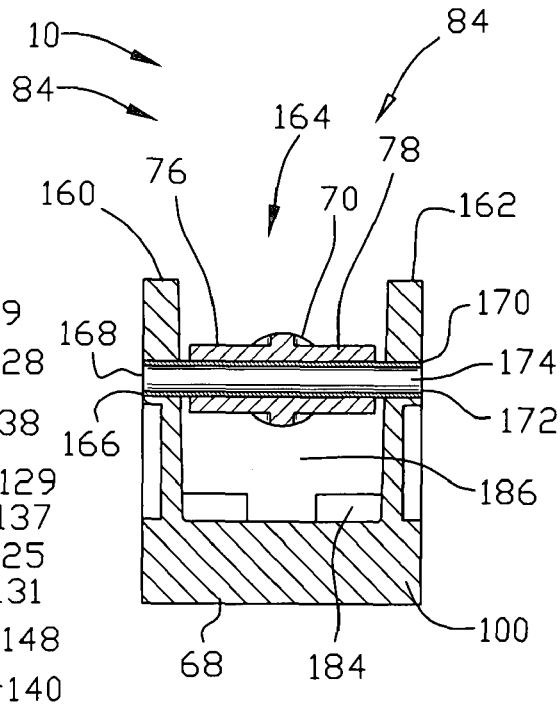
FIG. 22 is a sectional view along line 22-22 in FIG. 16.

As best seen in FIGS. 21 and 22, the bar member 70 further includes a first pivot body 76 and a second pivot body 78. Preferably the bar member 70, first pivot body 76 and second pivot body 78 are an integral one piece unit. The integral one piece unit may be constructed from a polymeric material by injection molding. The first and second pivot bodies 76 and 78 permit the cross sectional area of the bar member to be reduced. The first and second pivot bodies 76 and 78 also permit the width of the base 100 to be increased by allowing the first and second pivot bodies 76 and 78 to span an increased distance between the first and second shoulders 160 and 162.

Figure 13:
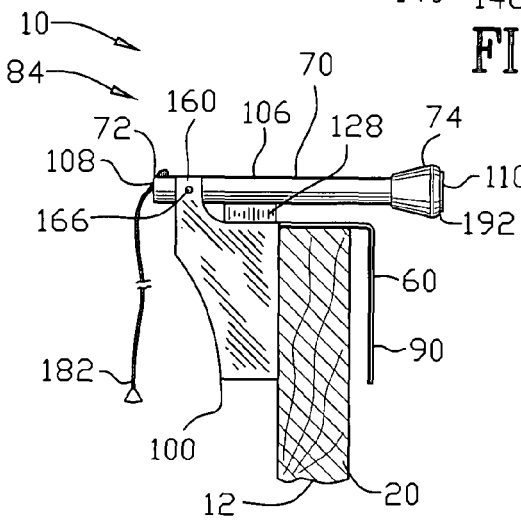
FIG. 13 is view similar to FIG. 3 illustrating the door safety device engaging the door.
Figure 14:
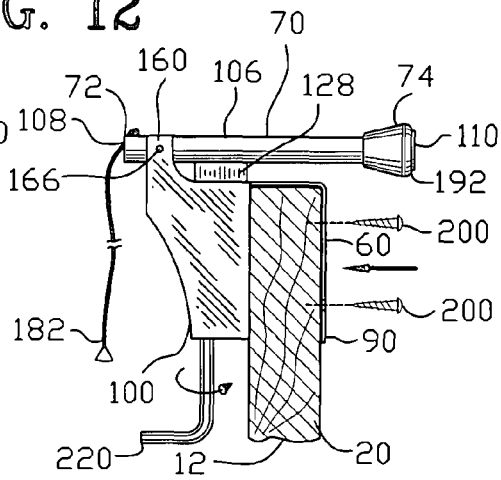
FIG. 14 is a view similar to FIG. 13 illustrating a plurality of fasteners securing the door safety device to the door.
Figure 16:
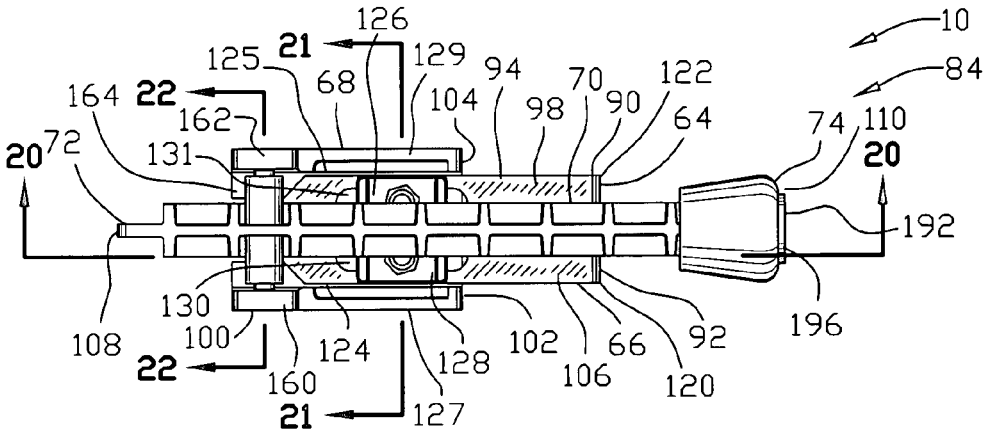
FIG. 16 is a top view of FIG. 15.
Figure 15:
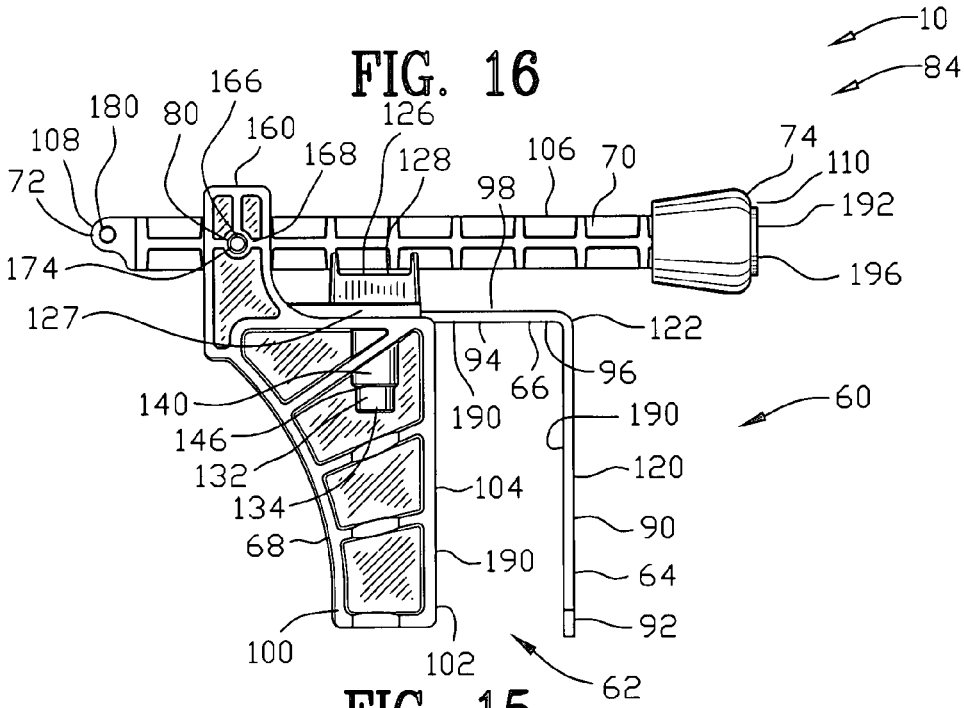
FIG. 15 is a side view illustrating a second embodiment of the present invention.
Figure 17:
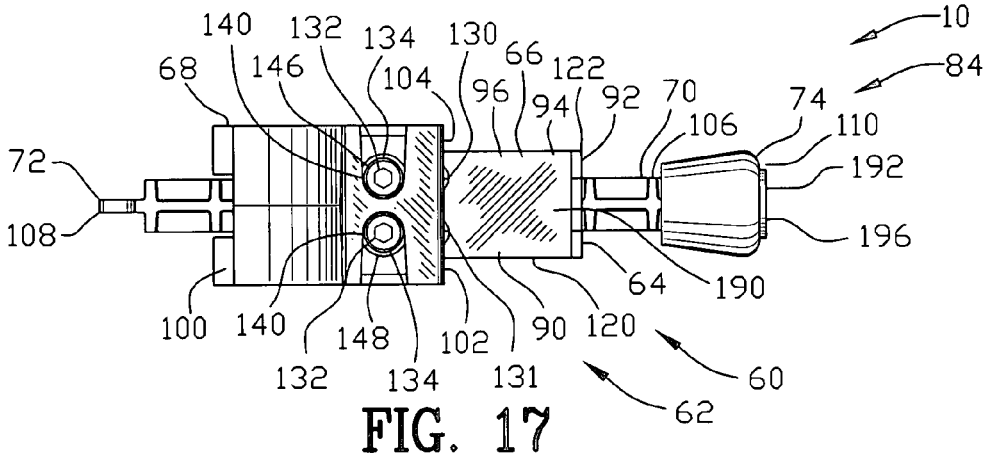
FIG. 17 is a bottom view of FIG. 15.
Figure 18:
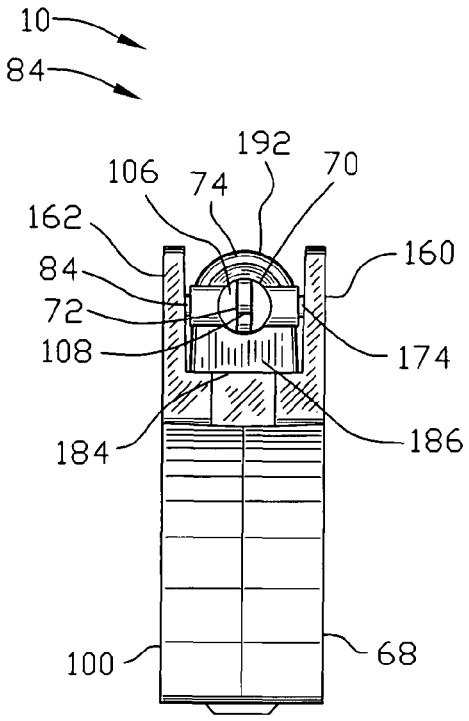
FIG. 18 is a rear view of FIG. 15.
Figure 19:
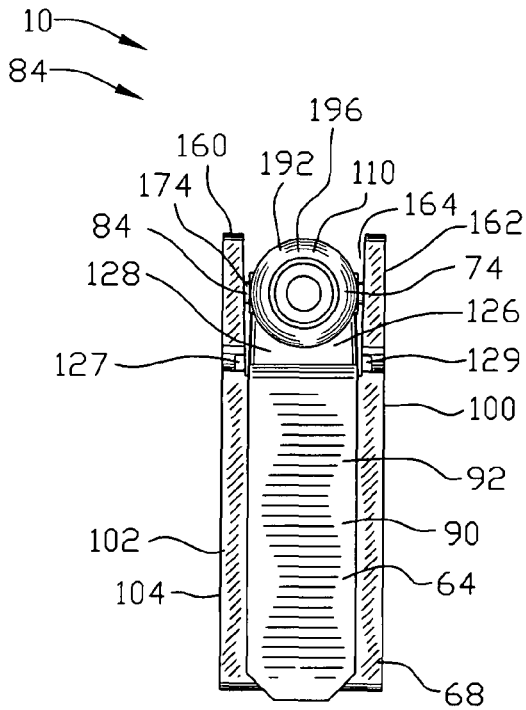
FIG. 19 is a front view of FIG. 15.
Figure 20:
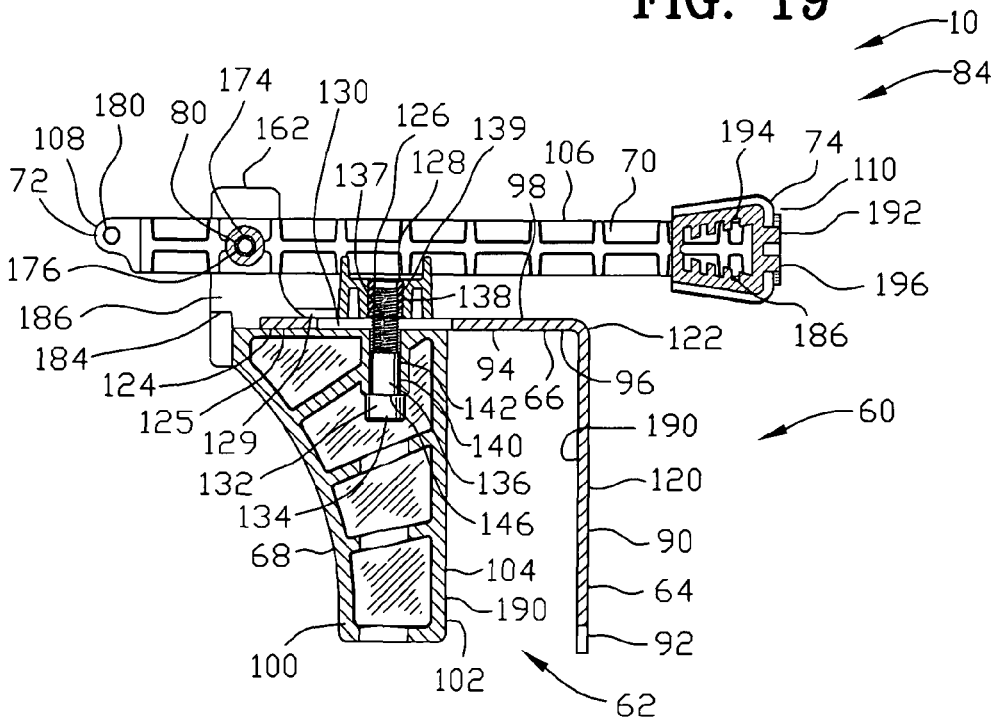
FIG. 20 is a sectional view along line 20-20 in FIG. 16.

As best seen in FIGS. 13 and 14, to utilize the present invention the apparatus 10 is first positioned on the door 20. The clamp 126 is disengaged with the base 100 such that the L-shaped frame 90 is distanced from the base 100. Preferably, the distance between the first leg 92 and the third leg 104 is greater than the depth of the door 20. The slot 62 defined by the first leg 92, the second leg 94 and the third leg 104 is positioned adjacent to the exterior side 24, the top edge 26 and the interior side 22 of the door 20 respectively. The L-shaped frame 90 is then slidably positioned into the base 100 until the first and third legs 92 and 104 are adjacent to the exterior and interior sides 24 and 22 respectively. The tool 220 is then engaged with the fastener head 134 for rotating the clamp fastener 132. Upon rotation of the clamp fastener 132, the male threading 138 threadably engages the female threading 139 to shorten the distance between the fastener head 134 and the clamp block 128 to produce a compressive force between the base 100 and the clamp block 128. The compressive force secures the second leg 94 against the channel surface 125 of the base 100 to fix the distance the first leg 92 and the third leg 104.

Figure 23:
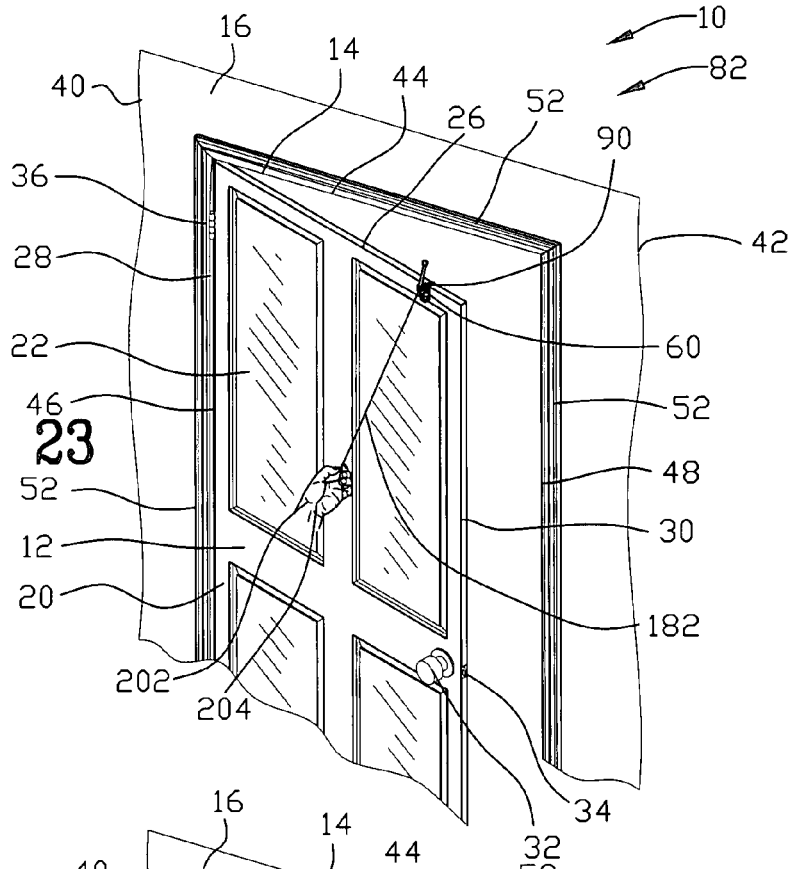
FIG. 23 is a view similar to FIG. 1 illustrating an adult positioned to an interior of the door to position the bar member in the generally vertical position.
Figure 24:
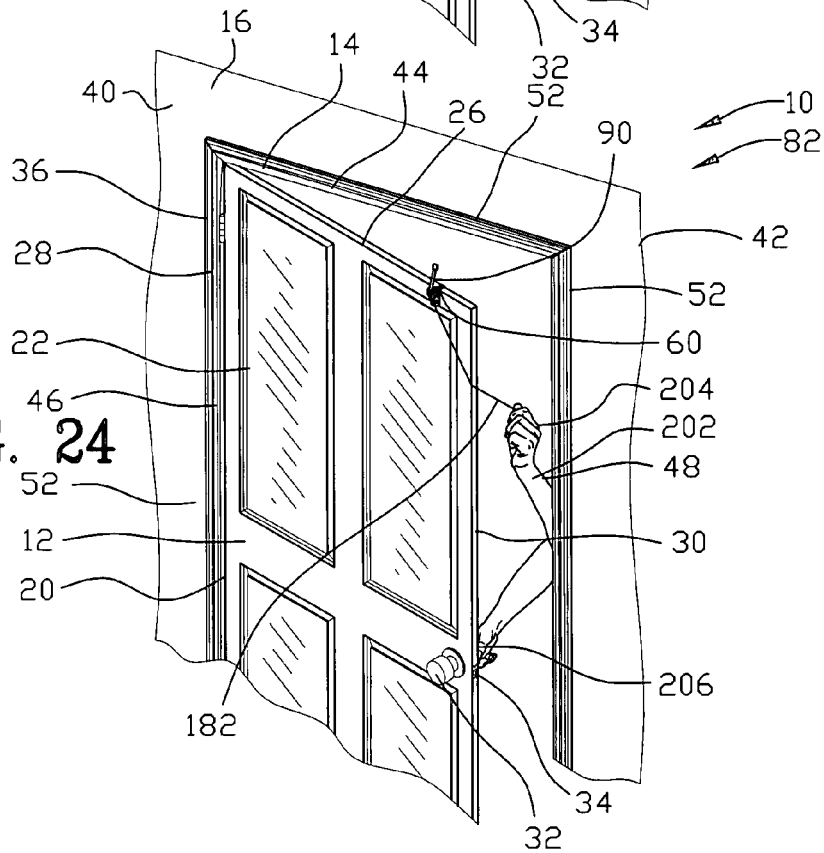
FIG. 24 is a view similar to FIG. 23 illustrating the adult positioned to an exterior of the door to position the bar member in the generally vertical position.
Figure 25:
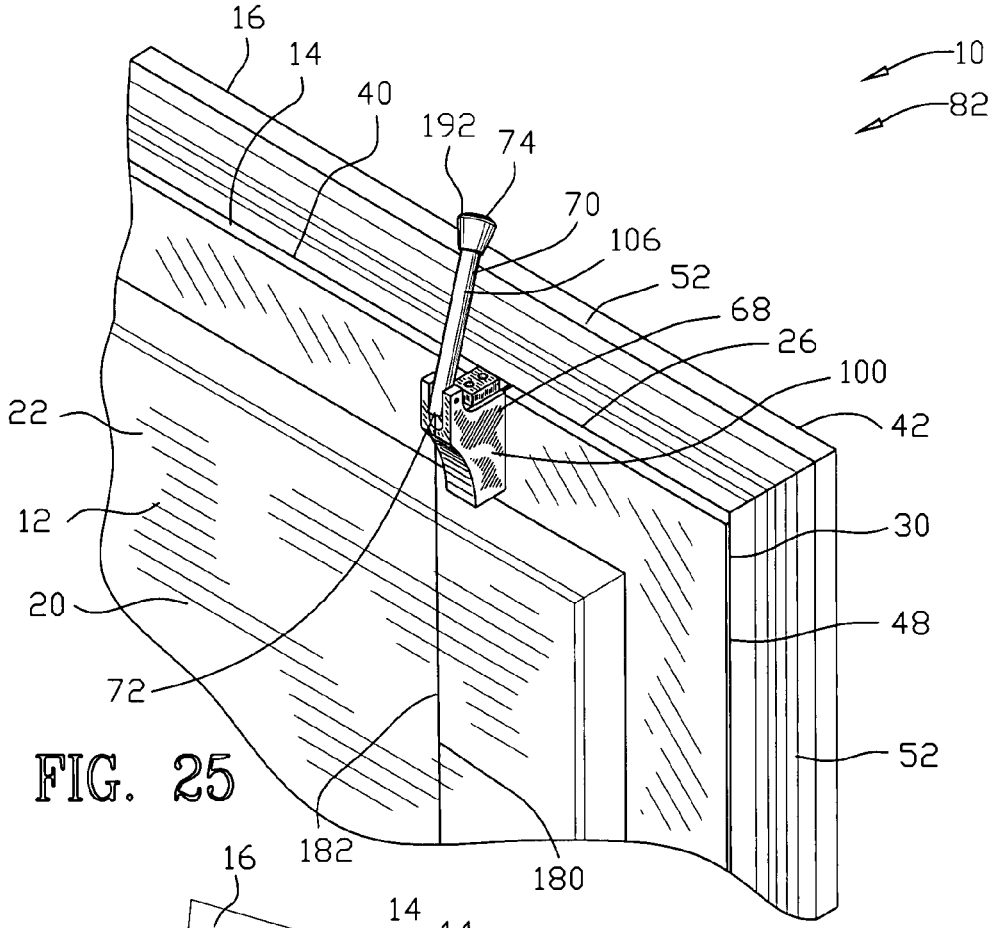
FIG. 25 is a magnified view of an upper portion of FIG. 1.

Since the bar member 70 is normally pivoted into the generally horizontal position 84 due to the fulcrum pivot 80 being positioned adjacent to the first end 108, the apparatus 10 will prevent the door 20 from closing the opening 14 within the wall 16 unless a bar member 70 is placed into the generally vertical position 82. As best seen in FIGS. 23 and 24, the bar member 70 is positioned into the generally vertical position 82 by a descending vertical force applied to the first end 72 of the bar member 70. The descending vertical force causes the bar member 70 to pivot about the fulcrum pivot 80. A cable aperture 180 may be located on the first end 72 of the bar member 70. A flexible cable 182 is secured to the cable aperture 180 and hangs vertically from the apparatus 10. Upon an adult 202 applying a downward vertical force on the flexible cable 182, the force is transferred to the first end 72 of the bar member 70 to pivot the bar member 70 about the fulcrum pivot 80. The length of the flexible cable 182 is not long enough to allow a child 208 to reach the flexible cable 182 to position the bar member 106 into the generally vertical position 82. As such a child 208 may not close the opening 14 within the wall 16 with the door 20.

The flexible cable 182 permits the adult 202 to place the bar member 106 in the generally vertical position 82 whether the adult 202 is standing on the interior side 40 of the wall 16 as shown in FIG. 23 or standing on the exterior side 42 of the wall 16 as shown in FIG. 24. As shown in FIG. 24 the flexible cable 182 may be placed over the handle edge 30 to redirect the flexible cable 182 from the interior side 22 of the door 20 to the exterior side 24 of the door 20. Alternatively, the base 100 may include a slit 112 positioned on the bottom edge of the base 100 for slidably receiving the flexible cable 182. The slit 112 redirects the flexible cable 182 from a descending direction to an ascending direction. The flexible cable 182 may then be placed over the tope edge 26 of the door 20 to redirect the flexible cable 182 from the interior side 22 of the door 20 to the exterior side 24 of the door 20.

To close the opening 14 with the door 20, the adult 202 must simultaneously retain the bar member 106 in the generally vertical position 82 and position the door 20 within the opening 14. The apparatus 10 permits the closure of the opening 14 by the door 20 in that the stopper pad 192 of the bar member 106 is prevented from striking the wall 16. In addition, the height of the second leg 94 allows the second leg 94 to be positioned between the top edge 26 of the door 20 and the top jamb 44 of the opening 14 without any friction between the second leg 94 and either the top edge 26 or the top jamb 44.

Figure 26:
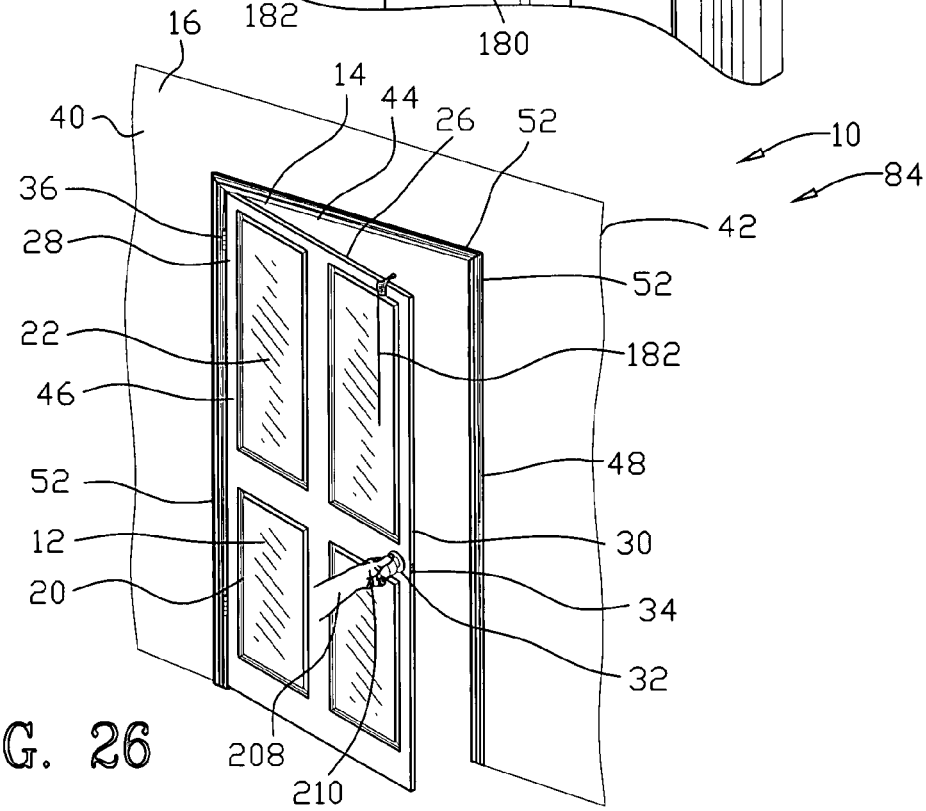
FIG. 26 is a view similar to FIG. 2 illustrating a child removing the door from the closed position and the bar member in the generally horizontal position.
Figure 27:
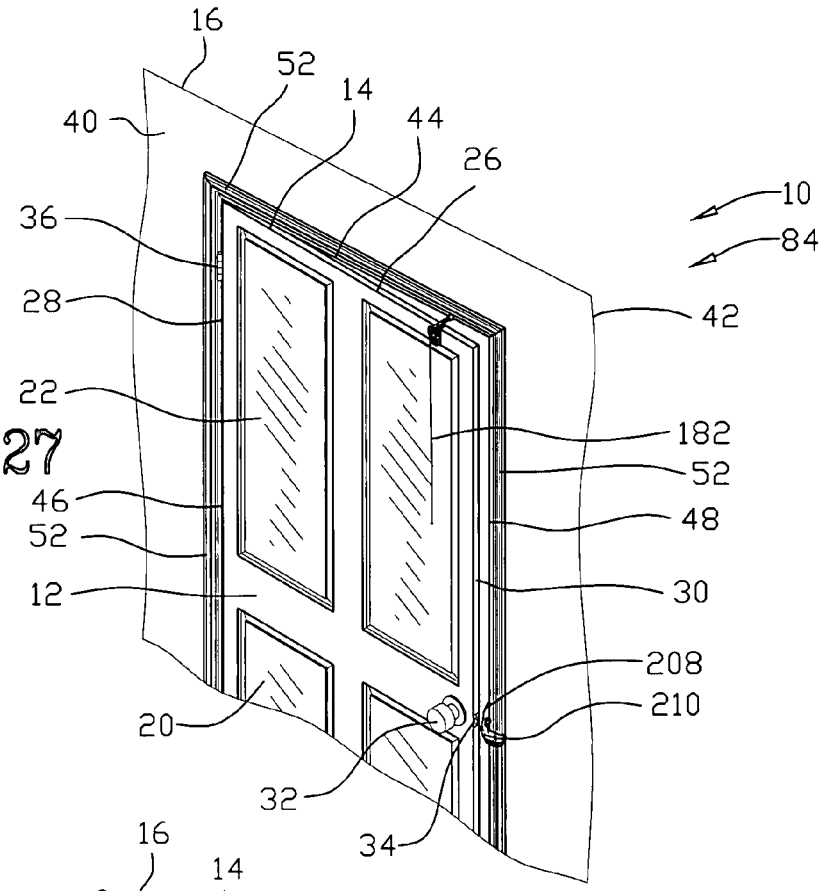
FIG. 27 is a magnified view of FIG. 2 illustrating a limb of a child positioned between the door and the door jamb.
Figure 28:
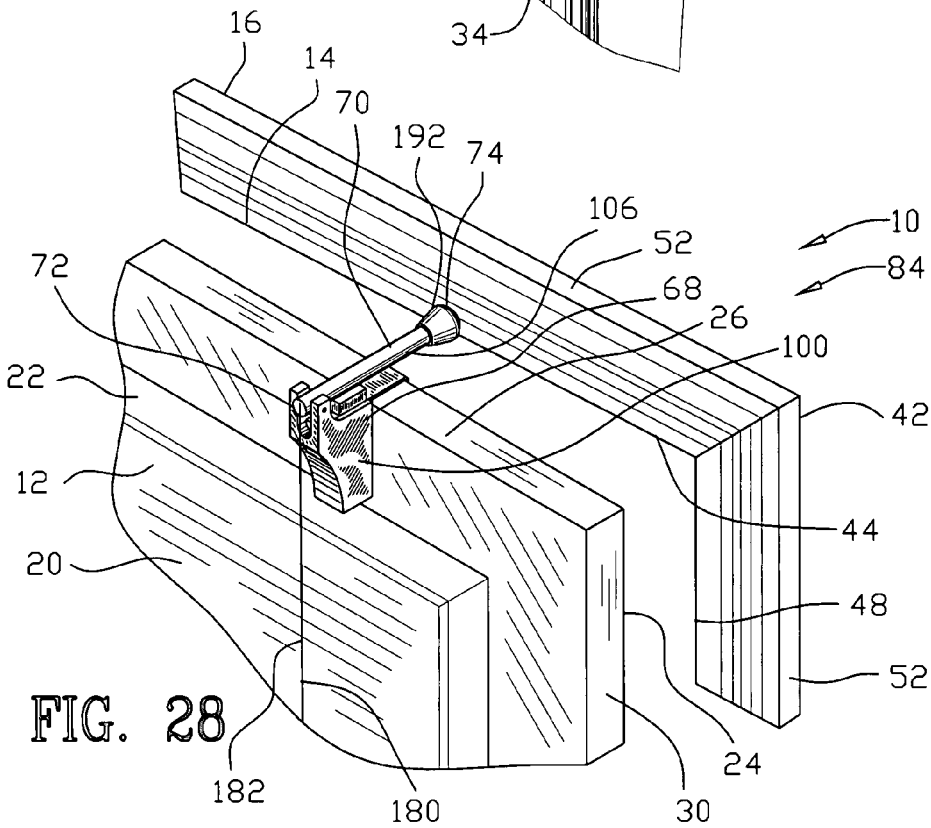
FIG. 28 is a magnified view of an upper portion of FIG. 27.

If a child 208 removes the door 20 from the opening 14 as shown in FIG. 26, the bar member 106 pivots from the generally vertical position 82 to the generally horizontal position 84. As shown in FIG. 27, any subsequent attempts to reposition the door 20 into the opening 14 without the bar member 106 being placed in the generally vertical position 82 will fail. As best seen in FIG. 28, the door 20 is prevented from closing the opening 14 by the bar member 106 striking the wall 16 to repel the door 20 from the opening 14. As such if the child places their head, limbs or other objects between the door 20 and the opening 14 during the attempted closure, the object will not be compressed and will have avoided possible damage and/or pain.

Figure 29:
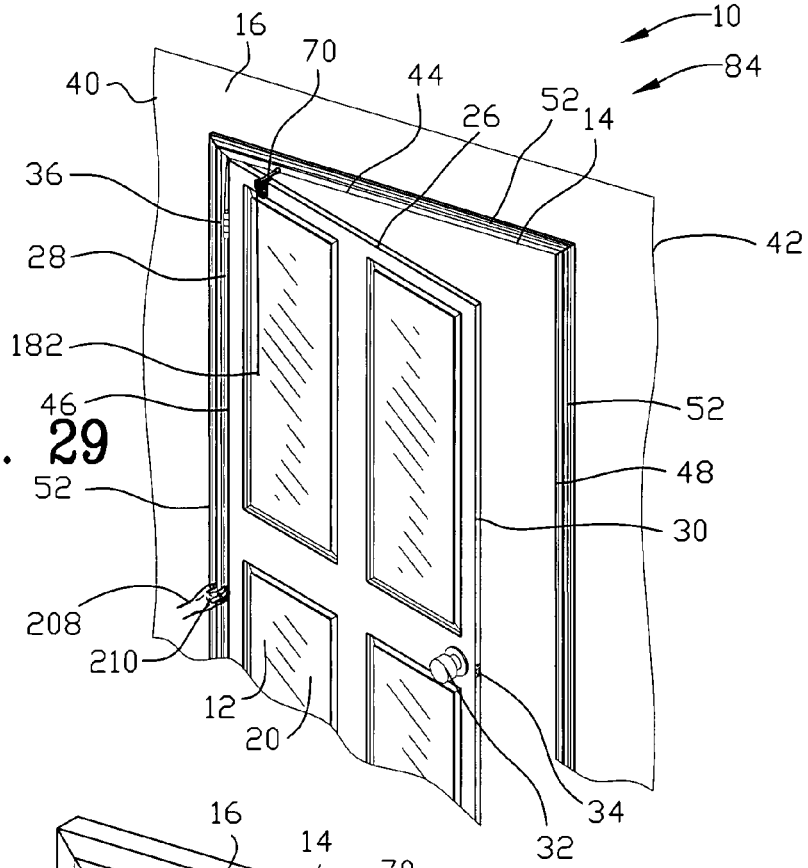
FIG. 29 is a view similar to FIG. 27 illustrating the door safety device in an dissimilar location.
Figure 30:
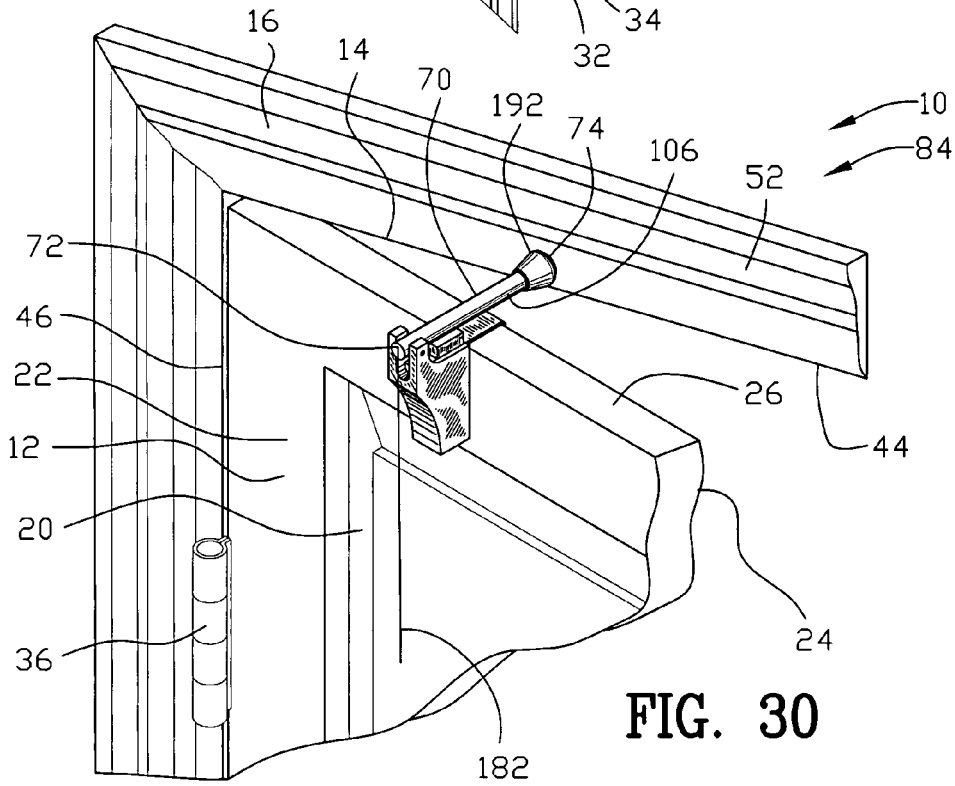
FIG. 30 is a magnified view of an upper portion of FIG. 29.
Figure 31:
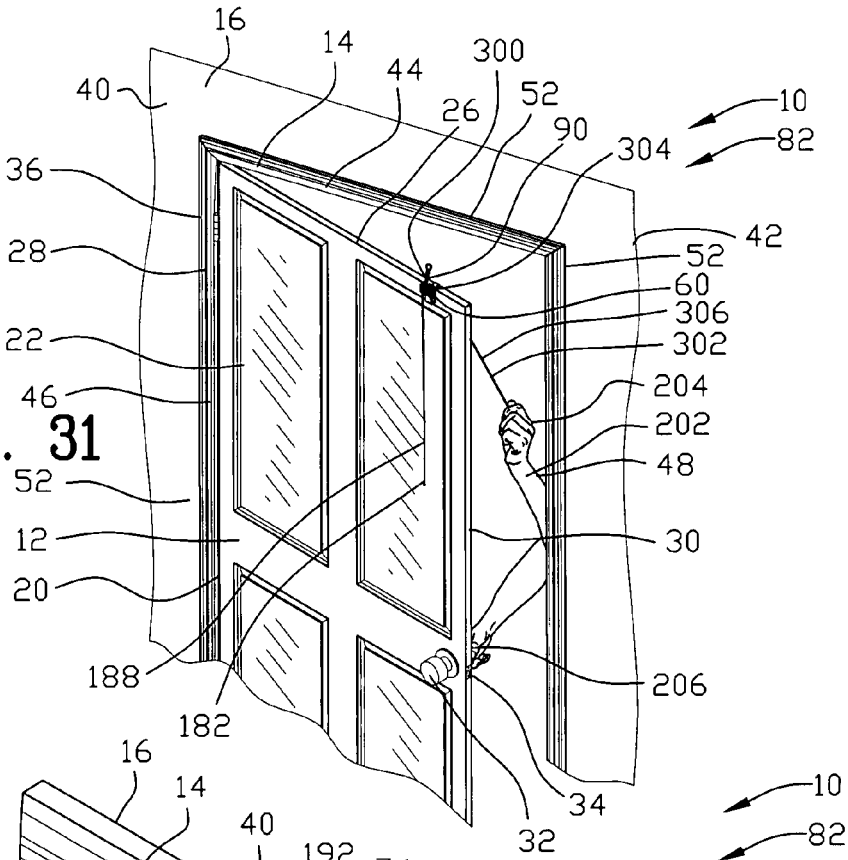
FIG. 31 is a view similar to FIG. 24 illustrating a third embodiment of the present invention.
Figure 32:
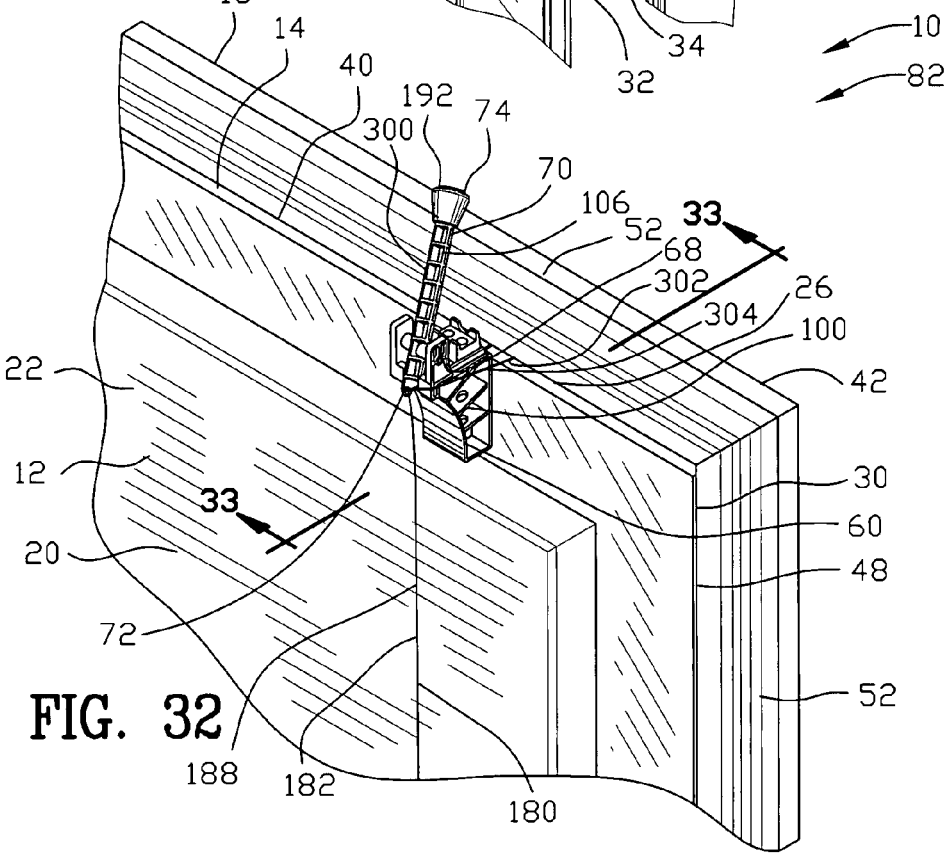
FIG. 32 is magnified view of an upper portion of FIG. 31 illustrating a door safety device permitting a door to close an opening within a wall incorporating the present invention.
Figure 33:
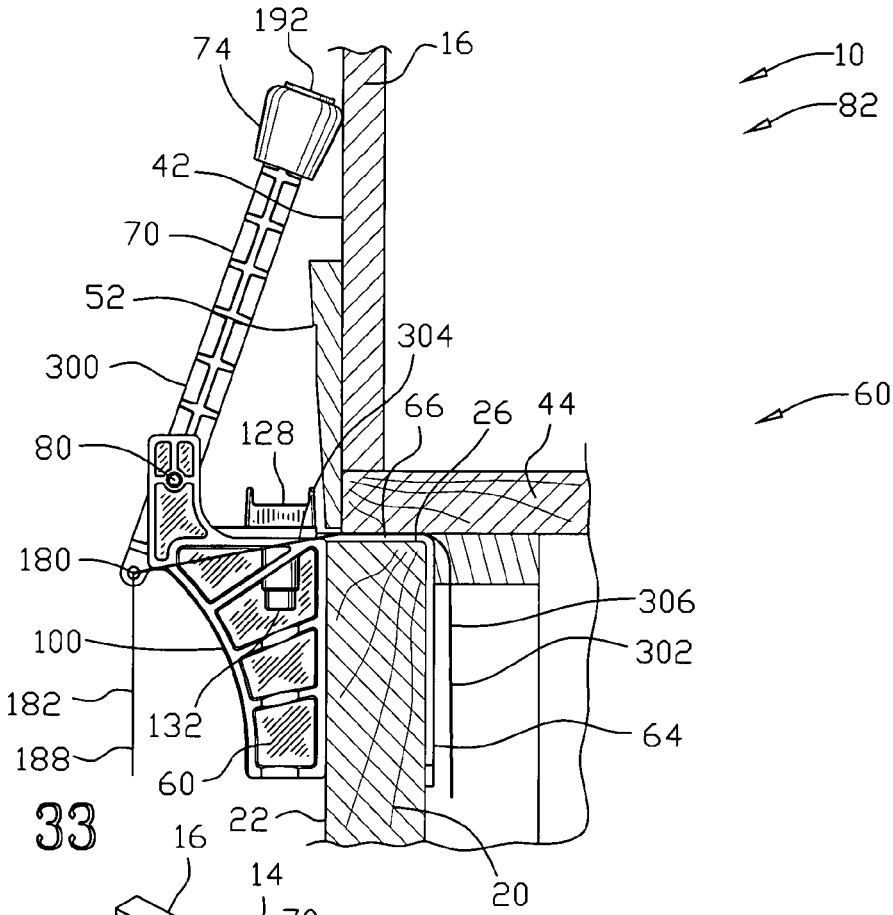
FIG. 33 is a sectional view along line 33-33 in FIG. 32.
Figure 34:
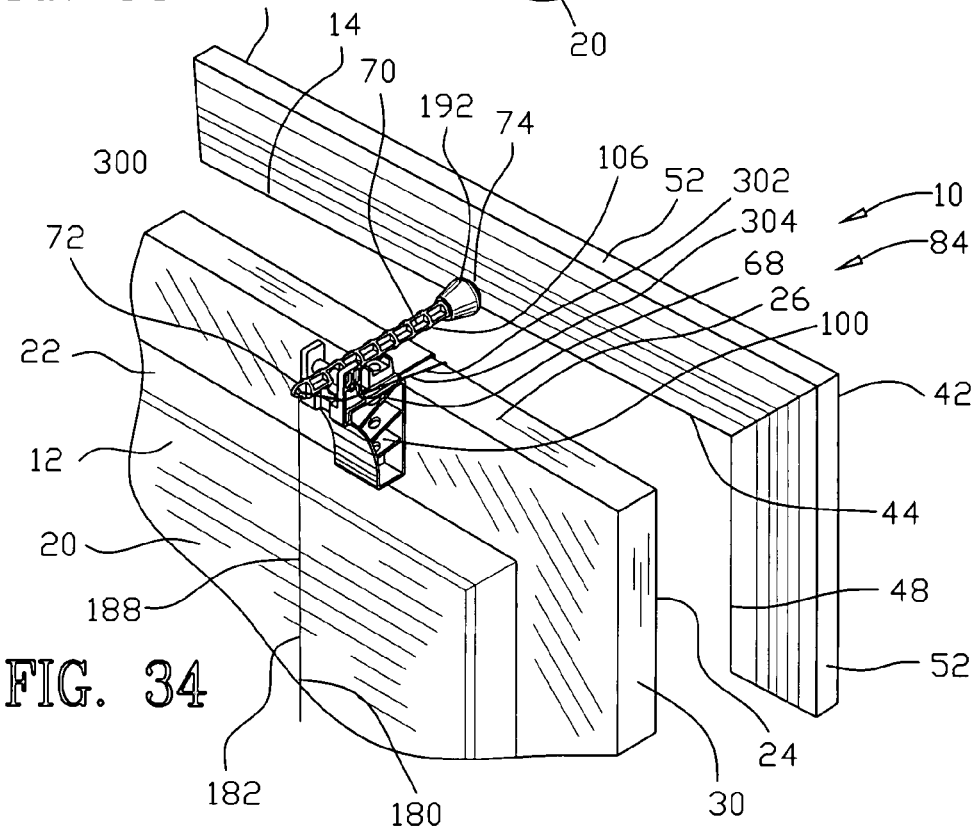
FIG. 34 is a view similar to FIG. 32 illustrating the door safety device preventing the door from closing the opening within the wall.

As best seen in FIGS. 27 thru 30 the distance between the door 20 and the opening 14 before the door 20 is repelled may be varied by positioning the apparatus 10 at differing locations along the top edge 26 of the door 20. As shown in FIGS. 27 and 28 if the apparatus 10 is located adjacent to the handle jamb 48, the distance between the door 20 and the opening 14 upon repelling will be at the lowest. As shown in FIGS. 29 and 30 if the apparatus 10 is located adjacent to the hinge jamb 46, the distance between the door 20 and the opening 14 upon repelling will be at the greatest.

FIGS. 31-34 illustrate a third embodiment 300 of the present invention. A first flexible cable 180 is secured to the first end 72 of said bar member 70 and positioned on the interior side 40 of the panel 12. A generally vertical force applied to the first flexible cable 180 conveys a generally descending vertical force to the first end 72 of the bar member 70 for pivoting the bar member 70 from the generally horizontal position to the generally vertical position. A second flexible cable 302 is secured to the first end 72 of the bar member 70 and positioning on the exterior side 42 of the panel 12. A generally vertical force applied to the second flexible cable 302 conveys a both a generally descending vertical and horizontal force to the first end 72 of the bar member 70 for pivoting the bar member 70 from the generally horizontal position to the generally vertical position.

The first flexible cable 180 includes a single cable portion 188 extending generally vertically from the first end 72 of the bar member 70. The second flexible cable 302 including a primary cable portion 304 and a secondary cable portion 306. The primary cable portion 304 extends generally horizontally from the first end 72 of the bar member 70 and over the inverted generally u-shaped frame 60. The second cable portion 306 extends generally vertical from the inverted generally u-shaped frame 60. The positioning of the primary and secondary cable portions 304 and 306 permit the second flexible cable 302 to traverse between the panel 12 and the top jamb 44 to position the second flexible cable 302 on the exterior side 42 of the panel 12. Since the second flexible cable 302 is positioned on the exterior side 42 of the panel 12, an operator is able to utilized the apparatus 10 where the operator is positioned on the exterior side 42 of the panel 12. The third embodiment 300 is most beneficial when the apparatus 10 is positioned adjacent to the hinge jamb 46 as best seen in FIGS. 29 and 30.

The first end 72 of the bar member 70 has a cable aperture 180 for fastening the first flexible cable 182 and the second flexible cable 302 to the bar member 70. The cable aperture 180 may have an elevation greater than an elevation of the fulcrum pivot 80 for permitting the second flexible cable 302 to pivot the bar member 70 from the generally horizontal position to the generally vertical position. The cable aperture 180 may have an elevation greater than an elevation of the inverted generally u-shaped frame 60 for permitting the second flexible cable 302 to pivot the bar member 70 from the generally horizontal position to the generally vertical position.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for permitting or preventing a panel from closing an opening within a wall, the panel having an interior side, an exterior side and a top edge, the wall having a top jamb, first side jamb and a second side jamb for defining the opening, a hinge securing the panel to the wall for pivoting the panel relative to the opening, the apparatus, comprising:

an inverted generally u-shaped frame defining a slot for positioning adjacent to the top edge, the interior side and the exterior side of the panel;

a bar member having a first end and a second end;

a fulcrum pivot interposed between said first end and said second end for pivotably mounting said bar member to said inverted generally u-shaped frame;

said fulcrum pivot pivoting said bar member between a generally vertical position wherein said second end is raised above said first end and a generally horizontal position;

said fulcrum pivot positioned adjacent to said first end for normally pivoting said bar member into the generally horizontal position;

a downward vertical force applied to said first end for pivoting said bar member from said generally horizontal position to said generally vertical position;

said bar member pivoted from said generally horizontal position to said generally vertical position by said downward vertical force applied on said first end for disengaging said second end from the wall for permitting the door to close the opening of the wall; and said bar member automatically pivoting from said generally vertical position to said generally horizontal position upon the door being removed from the opening for engaging said second end with the wall for preventing closing the opening with the door.

2. An apparatus for preventing a panel from positioning within an opening as set forth in claim 1, wherein said inverted generally u-shaped frame defines a first leg, a second leg and a base;

said second leg having a leg support surface and a leg engaging surface;

said base having a surface defining a third leg extending generally perpendicular to said second leg;

said base including a channel for slidably engaging said leg support surface of said second leg for altering the distance between said first leg and said third leg; and a clamp for locking said base relative to said second leg.

3. An apparatus for preventing a panel from positioning within an opening as set forth in claim 1, wherein said inverted generally u-shaped frame defines a first leg, a second leg and a base;

said second leg having a leg support surface and a leg engaging surface;

said base having a surface defining a third leg extending generally perpendicular to said second leg;

said base including a channel for slidably engaging said leg support surface of said second leg for altering the distance between said first leg and said third leg;

a clamp for locking said base relative to said second leg;

a groove within said second leg for aligning said second leg relative to said clamp; and said clamp including a clamp block positioned adjacent to said leg engaging surface and a fastener extending from said base, through said groove and to said clamp block for applying a compressive force between said base and said clamp block.

4. An apparatus for preventing a panel from positioning within an opening as set forth in claim 1, wherein said inverted generally u-shaped frame defines a first leg, a second leg and a base;

said second leg having a leg support surface and a leg engaging surface;

said base having a surface defining a third leg extending generally perpendicular to said second leg;

said base includes a first shoulder and a second shoulder extending generally perpendicular to said second leg;

said first shoulder having a first pivot receiver having an elevation greater than an elevation of said second leg;

said second shoulder having a second pivot receiver having an elevation greater than an elevation of said second leg;

a passage defined between said first shoulder and said second shoulder for positioning said bar member therebetween;

said first pivot receiver of said first shoulder pivotably securing said fulcrum pivot to said first shoulder; and said second pivot receiver of said second shoulder pivotably securing said fulcrum pivot to said second shoulder.

5. An apparatus for preventing a panel from positioning within an opening as set forth in claim 1, wherein a flexible cable is secured to said first end for conveying said downward vertical force from said flexible cable to said first end for pivoting said arm member from said generally horizontal position to said generally vertical position.

6. An apparatus for preventing a panel from positioning within an opening as set forth in claim 1, wherein said inverted generally u-shaped frame defines a first leg, a second leg and a base;

said first leg and said second leg including a metallic material; and said base and said bar member including a polymeric material.

7. An apparatus for preventing a panel from positioning within an opening as set forth in claim 1, wherein said inverted generally u-shaped frame defines a first leg, a second leg and a base;

said second leg having a leg support surface and a leg engaging surface;

said base having a surface defining a third leg extending generally perpendicular to said second leg;

said first leg, said leg support surface of said second leg and said third leg of said base including a shielding layer for protecting the door from scratching.

8. An apparatus for preventing a panel from positioning within an opening as set forth in claim 1, wherein said second end of said bar member includes a stopper pad for distributing an impact force between said second end and the wall; and said stopper pad including a polymeric material.

9. An apparatus for permitting or preventing a door from closing an opening within a wall, the door having an interior side, an exterior side, a top edge, a hinge edge and a handle edge, the wall having a top jamb, a hinge jamb and a handle jamb for defining the opening, a hinge securing the hinge edge to the hinge jamb for pivoting the door relative to the opening, the apparatus, comprising:

a L-shaped frame defining a first leg and a second leg;

said second leg having a leg support surface and a leg engaging surface;

a base having a surface defining a third leg extending generally perpendicular to said second leg;

a slot defined by said first leg, said second leg and said third leg for positioning adjacent the exterior side, the top edge and the interior side of the door respectively;

a bar member having a first end and a second end;

a fulcrum pivot interposed between said first end and said second end for pivotably mounting said bar member to said base;

said fulcrum pivot pivoting said bar member between a generally vertical position wherein said second end is raised above said first end and a generally horizontal position;

said fulcrum pivot positioned adjacent to said first end for normally pivoting said bar member into the generally horizontal position;

a downward vertical force applied to said first end for pivoting said bar member from said generally horizontal position to said generally vertical position;

said bar member pivoted from said generally horizontal position to said generally vertical position by said downward vertical force applied on said first end for disengaging said second end from the wall for permitting the door to close the opening of the wall; and said bar member automatically pivoting from said generally vertical position to said generally horizontal position upon the door being removed from the opening for engaging said second end with the wall for preventing closing the opening with the door.

10. An apparatus for permitting or preventing a door from closing an opening within a wall as set forth in claim 9, wherein said base includes a channel for slidably engaging said leg support surface of said second leg for altering the distance between said first leg and said third leg; and a clamp for locking said base relative to said second leg.

11. An apparatus for permitting or preventing a door from closing an opening within a wall as set forth in claim 9, wherein said base includes a channel for slidably engaging said leg support surface of said second leg for altering the distance between said first leg and said third leg;

a clamp for locking said base relative to said second leg;

a groove within said second leg for aligning said second leg relative to said clamp; and said clamp including a clamp block positioning adjacent to said leg engaging surface and a fastener extending from said base, through said groove and to said clamp block for applying a compressive force between said base and said clamp block.

12. An apparatus for permitting or preventing a door from closing an opening within a wall as set forth in claim 9, wherein said base includes a first shoulder and a second shoulder extending generally perpendicular to said second leg;

said first shoulder having a first pivot receiver having an elevation greater than an elevation of said second leg, said second shoulder having a second pivot receiver having an elevation greater than an elevation of said second leg;

a passage defined between said first shoulder and said second shoulder for positioning said bar member therebetween;

said first pivot receiver of said first shoulder pivotably securing said fulcrum pivot to said first shoulder; and said second pivot receiver of said second shoulder pivotably securing said fulcrum pivot to said second shoulder.

13. An apparatus for permitting or preventing a door from closing an opening within a wall as set forth in claim 9, wherein said base includes a channel for slidably engaging said leg support surface of said second leg for altering the distance between said first leg and said third leg;

a clamp for locking said base relative to said second leg;

a groove within said second leg for aligning said second leg relative to said clamp;

said clamp including a clamp block positioning adjacent to said leg engaging surface and a fastener extending from said base, through said groove and to said clamp block for applying a compressive force between said base and said clamp block;

said base includes a first shoulder and a second shoulder extending substantially perpendicular to said second leg;

said first shoulder having a first pivot receiver having an elevation greater than an elevation of said second leg;

said second shoulder having a second pivot receiver having an elevation greater than an elevation of said second leg;

a passage defined between said first shoulder and said second shoulder for positioning said bar member therebetween;

said first pivot receiver of said first shoulder pivotably securing said fulcrum pivot to said first shoulder;

said second pivot receiver of said second shoulder pivotably securing said fulcrum pivot to said second shoulder; and said first and second pivot receiver having an elevation greater than an elevation of said clamp block for positioning said bar member parallel to said second leg in said generally horizontal position.

14. An apparatus for permitting or preventing a door from closing an opening within a wall as set forth in claim 9, wherein a flexible cable is secured to said first end for conveying said downward vertical force from said flexible cable to said first end for pivoting said arm member from said generally horizontal position to said generally vertical position.

15. An apparatus for permitting or preventing a door from closing an opening within a wall as set forth in claim 9, wherein said base includes a stop surface permitting said first end having an elevation less than an elevation of said second leg in said generally vertical position; and said stop surface engaging said first end for terminating pivoting of said arm member at said generally vertical position.

16. An apparatus for permitting or preventing a door from closing an opening within a wall as set forth in claim 9, wherein said first leg and said second leg includes a metallic material; and said base and said bar member includes a polymeric material.

17. An apparatus for permitting or preventing a door from closing an opening within a wall as set forth in claim 9, wherein said first leg, said leg support surface of said second leg and said third leg of said base includes a shielding layer for protecting the door from scratching.

18. An apparatus for permitting or preventing a door from closing an opening within a wall as set forth in claim 9, wherein said second end of said bar member includes a stopper pad for distributing an impact force between said second end and the wall; and said stopper pad includes a polymeric material.

19. An apparatus for permitting or preventing a door from closing an opening within a wall as set forth in claim 9, wherein said first leg includes a bore for permitting a fastener to transverse through said first leg; and said fastener applying a compressive force between said first leg and the exterior side of the door for locking said base, said first leg, and said second leg relative to the door.

20. A child protective device engaged by an adult for preventing a child from closing an opening with a door, the opening positioned within a wall, the door having an interior side, an exterior side, a top edge, a hinge edge and a handle edge, the wall having a top jamb, a hinge jamb and a handle jamb for defining the opening, a hinge securing the hinge edge to the hinge jamb for pivoting the door relative to the door jamb, the apparatus, comprising:

a L-shaped frame defining a first leg and a second leg;

said second leg having a leg support surface and a leg engaging surface;

a base having a surface defining a third leg extending generally perpendicular to said second leg;

a slot defined by said first leg, said second leg and said third leg for positioning adjacent the exterior side, the top edge and the interior side of the door respectively;

a bar member having a first end and a second end;

a fulcrum pivot interposed between said first end and said second end for pivotably mounting said bar member to said base;

said fulcrum pivot pivoting said bar member between a generally vertical position wherein said second end is raised above said first end and a generally horizontal position;

said fulcrum pivot positioned adjacent to said first end for normally pivoting said bar member into the generally horizontal position;

a flexible cable secured to said first end for conveying a downward vertical force from said flexible cable to said first end for pivoting said bar member from said generally horizontal position to said generally vertical position;

said bar member pivoted from said generally horizontal position to said generally vertical position by the adult applying said downward vertical force on said flexible cable for disengaging said second end from the wall for permitting the door to close the opening of the wall; and said bar member normally automatically pivoting from said generally vertical position to said generally horizontal position upon the child displacing the door from the opening for engaging said second end with the wall for preventing the child from closing the opening with the door.

* * * * *